US009274468B2

(12) United States Patent
Tadomi

(10) Patent No.: US 9,274,468 B2
(45) Date of Patent: Mar. 1, 2016

(54) IMAGE HEATING APPARATUS

(71) Applicant: CANON KABUSHIKI KAISHA, Tokyo (JP)

(72) Inventor: Takuma Tadomi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/674,409

(22) Filed: Mar. 31, 2015

(65) Prior Publication Data

US 2015/0277316 A1 Oct. 1, 2015

(30) Foreign Application Priority Data

Apr. 1, 2014 (JP) ..... 2014-075363

(51) Int. Cl.
*G03G 15/20* (2006.01)

(52) U.S. Cl.
CPC ..... *G03G 15/2053* (2013.01); *G03G 15/2025* (2013.01); *G03G 15/2075* (2013.01)

(58) Field of Classification Search
CPC ..... G03G 15/2053; G03G 15/2025; G03G 15/2075
USPC ..... 399/327, 347; 219/216
See application file for complete search history.

(56) References Cited

U.S. PATENT DOCUMENTS 7,430,392 B2 9/2008 Ito et al.
7,460,821 B2 12/2008 Ai et al.
8,917,999 B2 * 12/2014 Takada ..... G03G 15/2025 399/320
2008/0038026 A1 2/2008 Ai et al.
2008/0038027 A1 2/2008 Ito et al.
2013/0129364 A1 * 5/2013 Kitagawa ..... G03G 15/2025 399/21
2013/0206745 A1 * 8/2013 Tanaka ..... H05B 1/00 219/469
2015/0016831 A1 * 1/2015 Chiyoda ..... G03G 15/2025 399/43
2015/0093128 A1 * 4/2015 Okamoto ..... G03G 15/2025 399/33
2015/0212465 A1 * 7/2015 Momma ..... G03G 15/2017 399/67

FOREIGN PATENT DOCUMENTS

JP 11-242401 A * 9/1999
JP 2008-040363 A 2/2008
JP 2008-040364 A 2/2008
JP 2008-266785 A 11/2008
JP 2012-173383 A * 9/2012
JP 2015-011184 A * 1/2015

* cited by examiner

*Primary Examiner* — Robert Beatty
(74) *Attorney, Agent, or Firm* — Fitzpatrick, Cella, Harper & Scinto

(57) ABSTRACT

An image heating apparatus includes first and second rollers forming a nip therebetween to heat a toner image on a sheet; a rubbing roller for rubbing an outer surface of said first roller; a moving mechanism for moving said rubbing roller between a contact position for contacting with said first roller and a spacing position spaced from said first roller; a measuring portion for measuring time elapsed from start of a rubbing process; a controller for discriminating, upon receipt of image heating instructions during the rubbing process execution, whether to continue the rubbing process or to interrupt the rubbing process and execute the image heating process, on the basis of the time measured by said measuring portion.

10 Claims, 15 Drawing Sheets

IMAGE HEATING APPARATUS

FIELD OF THE INVENTION AND RELATED ART

The present invention relates to an image heating apparatus for heating a toner image on a sheet of a recording medium. An image heating apparatus can be used by various image forming apparatuses such as a copying machine, a printer, a facsimile machine, and a multifunction machine capable of performing two or more functions of the preceding examples of an image forming apparatus.

Generally speaking, image forming apparatuses which use an electrophotographic method are equipped with a fixing device which fixes a toner image formed on a sheet of a recording medium (paper), in the nip which is between the two fixing members (rotational members) of the fixing device. In recent years, toners which are higher in meltability have been ardently developed. The higher the toner in meltability, the more uniformly and more satisfactorily the toner can be melted by a fixing device, and therefore, the more uniform and flatter, and therefore the toner layer (toner image) becomes higher in gloss as it is fixed. Thus, by using toner that is higher in meltability, it is possible to form an image that is glossier and higher in image quality than an image formed with the use of the conventional toner, or toner which is lower in meltability, on a sheet of highly glossy paper, such as a sheet of coated paper.

However, as the cumulative length of time of usage of the fixing device structured as described above increases, the surface properties of the portions of its fixing members (lengthwise ends in terms of direction perpendicular to the recording medium conveyance direction), which correspond in position to the edges of a sheet of the recording medium, are likely to deteriorate. More concretely, the areas of the surface of the fixing member, which come into contact with the edges of a sheet of the recording medium, are likely to become rougher than the rest. As the surface properties of the fixing member become non-uniform as described above, the non-uniform surface texture of the fixing member is reflected by the toner image as the toner is fixed. That is, as the unfixed toner image is fixed, the toner image becomes non-uniform in gloss, which is problematic.

Thus, the fixing devices disclosed in Japanese Laid-open Patent Applications 2008-040363 and 2008-040364 are provided with a roughening roller (rubbing rotatable member) for abrading the surface of the fixing member. More concretely, a fixing member is abraded by the roughening roller to make the portions of the fixing member, whose surface properties have deteriorated (surface roughness) due to their repeated contact with the sheet edges, inconspicuous in surface texture, in comparison to the other portions of the surface of the fixing member.

However, in a case where the surface of the fixing member is roughened with the use of a roughening roller as described in Japanese Laid-open Patent Applications 2008-040363 and 2008-040364, it is desired that the surface of the fixing member is continuously roughened for a certain length of time (60 seconds, for example) in order for the roughening process to be effective.

In the case of an image forming apparatus equipped with a fixing device structured as the one described above, if a command to start an image forming job (command to start image heating process) is received by the apparatus while the surface of the fixing member is roughened, it starts the job after the completion of the on-going roughening process.

SUMMARY OF THE INVENTION

According to an aspect of the present invention, there is provided an image heating apparatus comprising: first and second rotatable members cooperative with each other to form a nip therebetween for heating a toner image on a sheet; a rubbing rotatable member configured to rub an outer surface of the first rotatable member; a moving mechanism configured to move the rubbing rotatable member between a contact position in which it contacts the first rotatable member and a spacing position in which it is spaced from the first rotatable member; a measuring portion configured to measure the time elapsed from the start of a rubbing process executed with the rubbing rotatable member placed in the contact position; a controller for discriminating, upon receipt of execution instructions of the image heating process during the execution of the rubbing process, whether to continue the rubbing process or to interrupt the rubbing process and execute the image heating process, on the basis of the time measured by the measuring portion.

Further features of the present invention will become apparent from the following description of exemplary embodiments with reference to the attached drawings.

DESCRIPTION OF THE EMBODIMENTS

Embodiment 1

(1) Image Forming Apparatus

Figure 1:
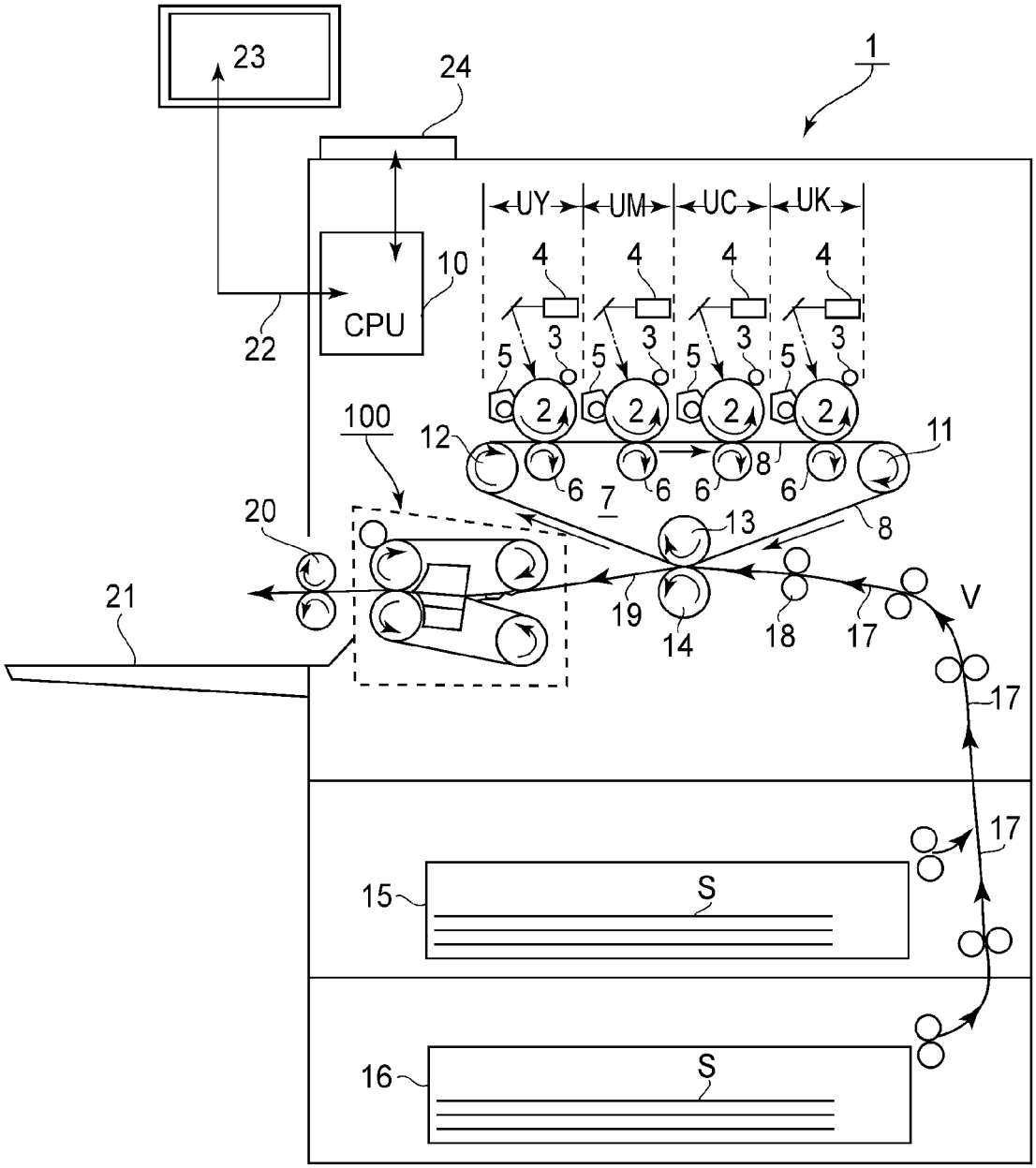
FIG. 1 is a sectional view of the image forming apparatus in the first embodiment of the present invention, and is for illustrating the image forming apparatus.

FIG. 1 is a schematic sectional view of the image forming apparatus 1 in this embodiment, at a vertical plane which is parallel to the direction V in which a sheet S of the recording medium is conveyed. It is for describing the structure of the apparatus 1. This image forming apparatus 1 (which hereafter is referred to simply as a-printer) is an electrophotographic full-color printer which employs an intermediary transferring member. This printer 1 can form an image which is in accordance with image data (electrical information about image to be formed) inputted into the printer control section 10 (which hereafter is referred to as CPU) from an external host apparatus 23 which is connected to the CPU 10 through an interface 22, on a sheet S, and outputs the sheet S as a print.

A CPU 10 is a controlling means which integrally controls the operation of the printer 1. It exchanges various electrical information signals with the external host apparatus 23 and the control panel of 24 of the printer 1. Further, it processes the electrical information signals inputted from various processing devices and sensors, command signals to be given to the various processing devices, and controls a preset initial sequence and a preset image formation sequence. The external host apparatus 23 is a personal computer, a network, an image reader, a facsimile machine, or the like, for example.

There are four (first to fourth) image formation sections (UY, UM, UC and UK), being aligned in tandem from left to right as shown in FIG. 1, in the printer 1. Each image formation section (UY, UM, UC and UK) is an electrophotographic image formation system. The four image formation sections (UY, UM, UC and UK) are the same in structure, although they are different in the color of the toner, as developer, stored in their developing device 5.

More concretely, each image formation section (UY, UM, UC and UK) has an electrophotographic photosensitive member 2 (which hereafter is referred to as a drum), and processing devices, more specifically, a charge roller 3, a laser scanner 4, a developing device 5, a primary transfer roller 6, etc., which perform processes on the drum 2.

The drum 2 in each image formation section (UY, UM, UC and UK) is rotationally driven at a preset speed in the counterclockwise direction indicated by an arrow mark. On the drum 2 of the first image formation section UY, a yellow toner image, which corresponds to the yellow color component of a full-color image to be formed, is formed. On the drum 2 of the second image formation section UM, a magenta (M) color toner image, which corresponds to the magenta color component of the image to be formed, is formed. On the drum 2 of the third image formation section UC, a cyan (C) color toner image, which corresponds to the cyan color component of the image to be formed, is formed. Further, on the drum 2 of the fourth image formation section UK, a black (K) toner image, which corresponds to the black color component of the image to be formed, is formed. The processes for forming a toner image on the drum 2 of each image formation section (UY, UM, UC and UK), and the principle based on which a toner image is formed on the drum 2 of each image formation section U, are well-known, and therefore, are not described here.

There is an intermediary transfer belt unit 7 on the bottom side of the combination of the four image formation sections (UY, UM, UC and UK). This unit 7 has an intermediary transfer belt 8, as an intermediary transferring member, which is flexible and endless. The belt 8 is suspended and tensioned by three rollers, which are a driver roller 11, a tension roller 12, and an idler roller 13 (which opposes a secondary transfer roller). As the driver roller 11 is driven, the belt 8 is circularly moved in the clockwise direction indicated by an arrow mark at a speed which corresponds to the rotational speed of the drum 2. Against the idler roller 13, the secondary transfer roller 14 is kept pressed with the application of a preset amount of force, with the presence of the belt 8 between the two rollers 13 and 14. The area of contact between the belt 8 and secondary transfer roller 14 is the secondary transfer nip.

The primary transfer roller 6 of each image formation section (UY, UM, UC and UK) is on the inward side of the loop which the belt 8 forms. It is kept pressed against the downwardly facing portion of the peripheral surface of the drum 2, with the placement of the belt 8 between the drum 2 and roller 6. The area of contact between the drum 2 of each image formation section (UY, UM, UC and UK) and the belt 8 is the primary transfer nip of the image formation section (UY, UM, UC and UK). To the primary transfer roller 6, a preset primary transfer bias is applied with preset control timing.

The yellow (Y), magenta (M), cyan (C) and black (K) toner images formed on the drums 2 of the image formation sections (UY, UM, UC and UK), respectively, are sequentially transferred in layers (primary transfer) onto the outward surface of the belt 8 in the primary transfer nips while the belt 8 is circularly moved. Consequently, an unfixed full-color image is synthetically formed on the belt 8, of the four monochromatic toner images, different in color, layered on the belt 8. Then, the unfixed full-color toner image is conveyed to the secondary transfer nip.

Meanwhile, sheets S of the recording medium stored in the first or second cassette 15 or 16 are fed one by one into the main assembly of the printer 1, by a sheet feeding-conveying mechanism, and are sent one by one to a pair of registration rollers 18 through a sheet conveyance passage 17. The pair of registration rollers 18 catch each sheet S, and temporarily hold the sheet S to correct the sheet S in attitude if the sheet S is angled relative to the sheet conveyance direction. Then, they send the sheet S to the secondary transfer nip with such timing that the sheet S arrives at the secondary transfer nip at the same time as the full-color toner image on the belt 8.

While the sheet S is conveyed, remaining pinched between the secondary transfer roller 14 and the belt 8, through the secondary transfer nip, a preset secondary transfer bias is applied to the secondary transfer roller 14. Thus, the full-color toner image on the belt 8 is transferred onto the sheet S as if it is peeled away from the belt 8. As the sheet S comes out of the secondary transfer nip, it is separated from the surface of the belt 8, and is guided into a fixing device 100 as an image heating device, through a recording medium conveyance passage 19. Then, the sheet S is subjected to heat and pressure in the fixing device. Thus, the unfixed toner image on the sheet S becomes fixed as a solid image to the sheet S. Then, as the sheet S comes out of the fixing device 100, it is conveyed further by a pair of discharged roller 20 to be discharged into a delivery tray 21.

(2) Fixing Device 100

Figure 2:
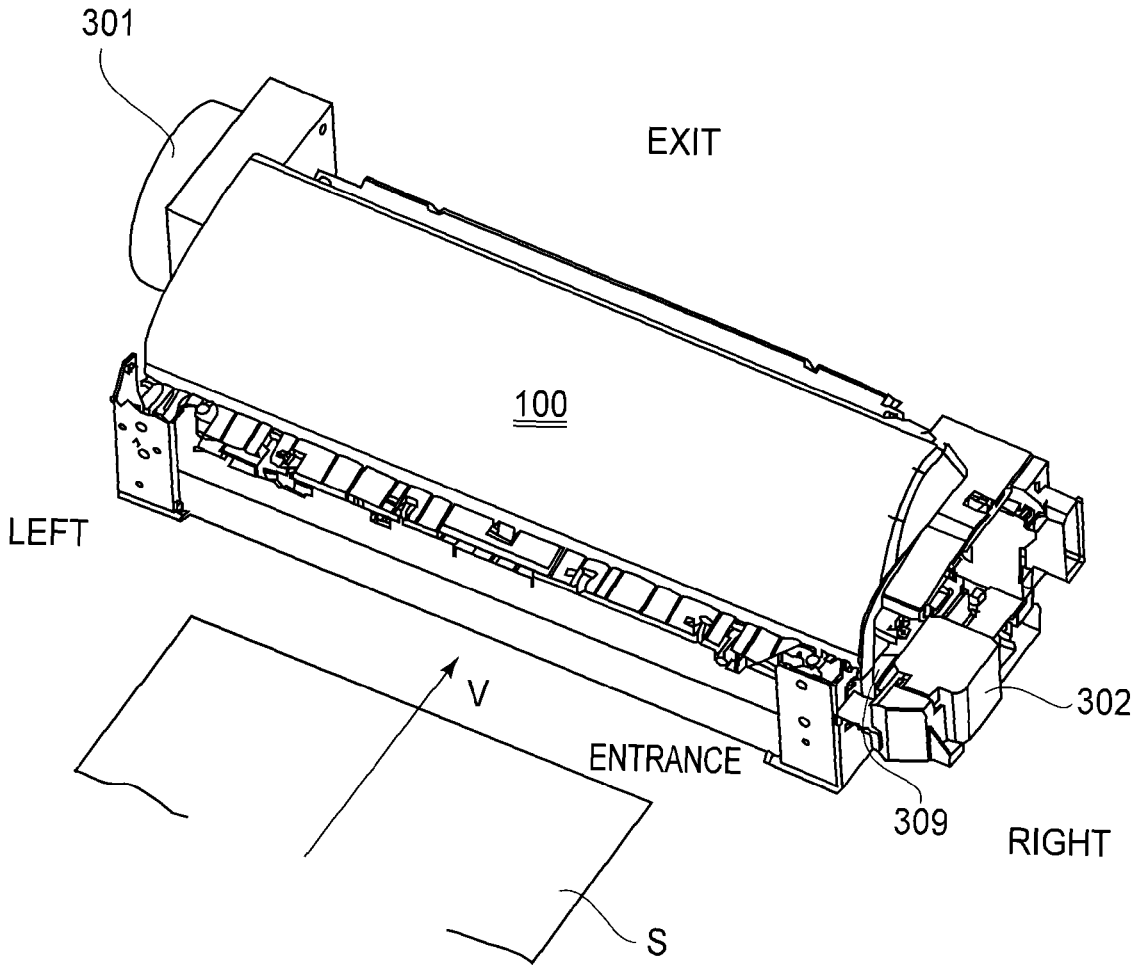
FIG. 2 is an external perspective view of the fixing device in the first embodiment.
Figure 3:
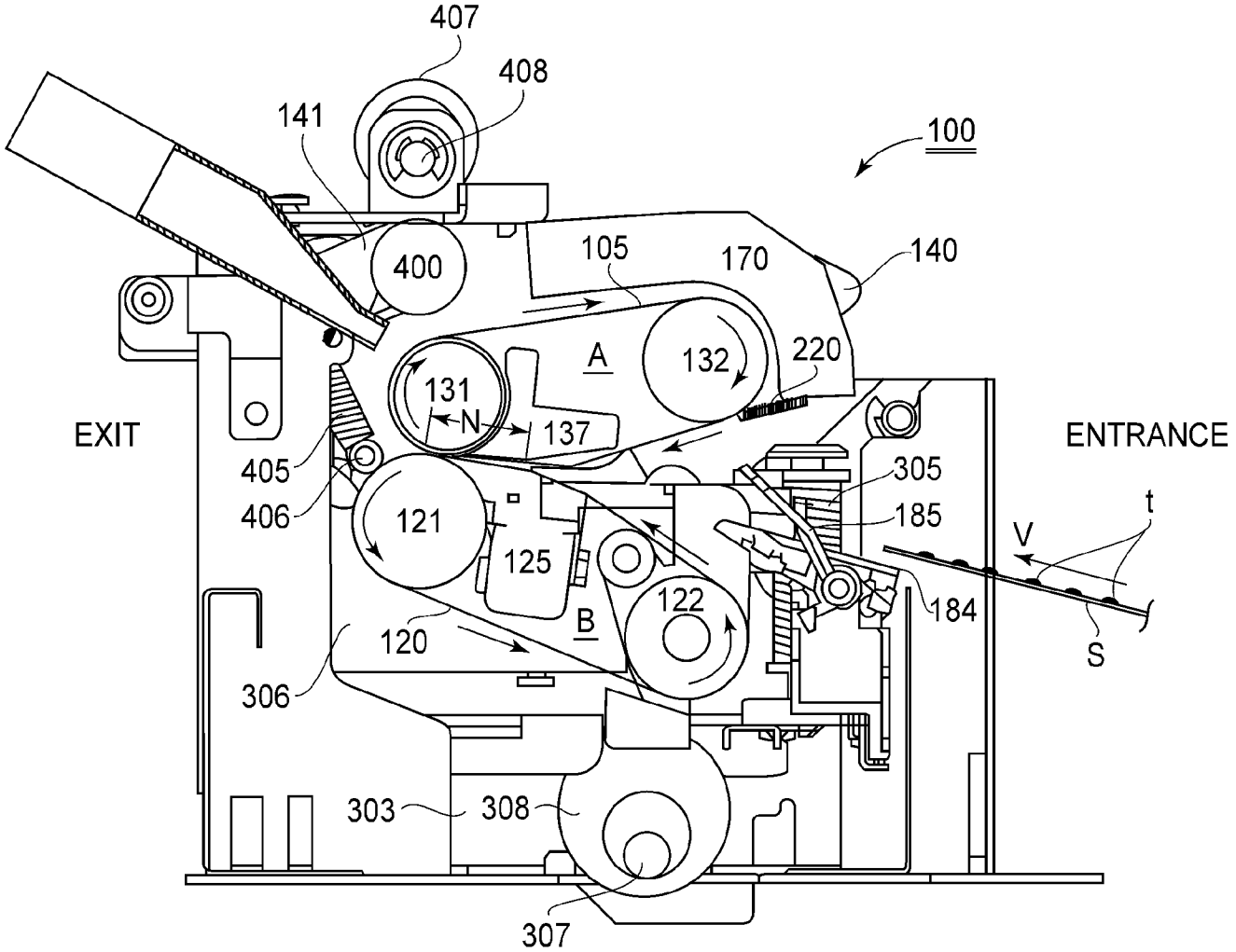
FIG. 3 is a cross-sectional view of the essential portion of the fixing device, as seen from the right side of the device (when bottom belt assembly B is under pressure).
Figure 4:
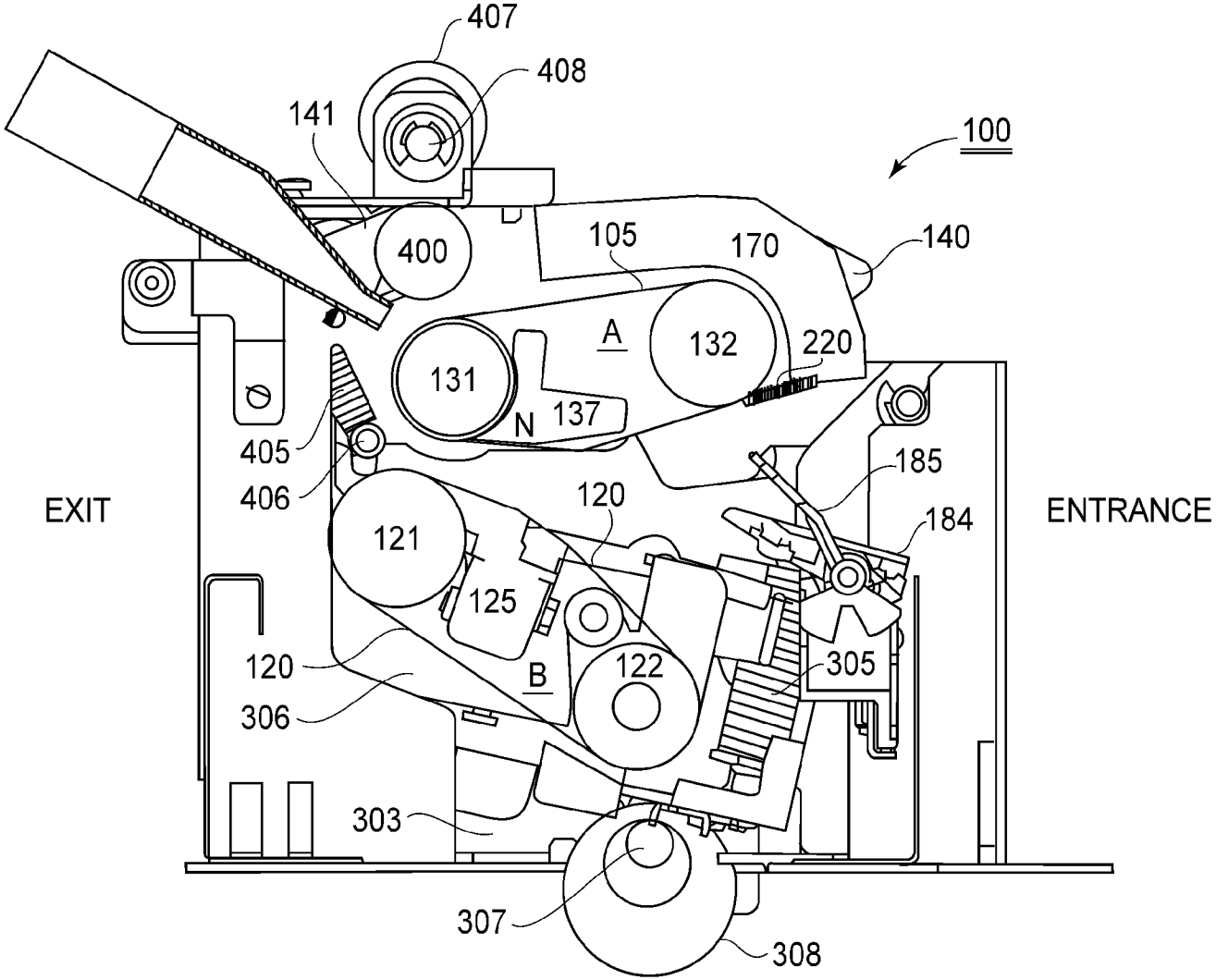
FIG. 4 is a cross-sectional view of the essential portion of the fixing device as seen from the left side of the device (when bottom belt assembly is remaining separated from top belt assembly).
Figure 5:
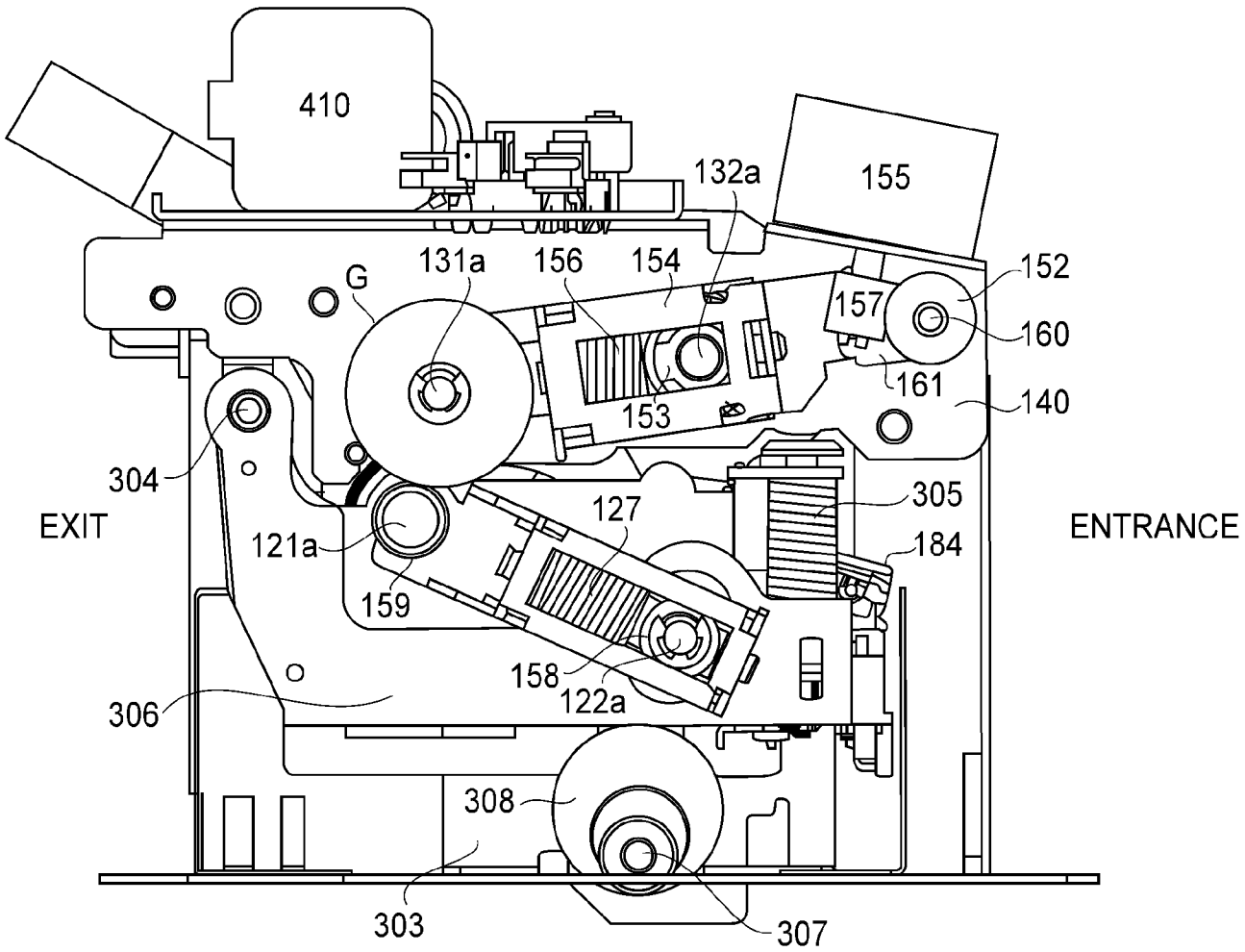
FIG. 5 is a cross-sectional view of the essential portion of the fixing device, as seen from the left side of the device (when bottom belt assembly B is under pressure).
Figure 6:
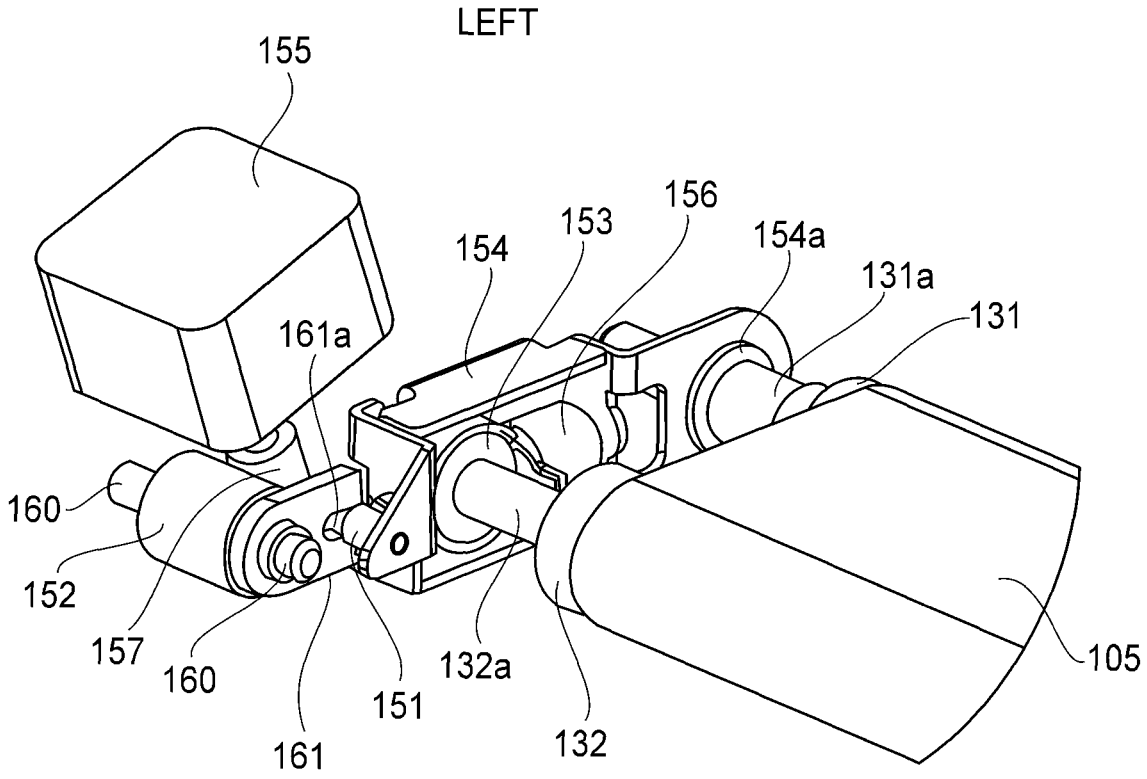
FIG. 6 is a perspective view of the belt deviation control mechanism.

FIG. 2 is an external perspective view of the fixing device 100 as an image heating device. FIG. 3 is a vertical cross-sectional view of the essential portion of the fixing device 100, as seen from the right side of the device 100. It shows the fixing device 100 when the bottom belt assembly B is under pressure. FIG. 4 is a vertical cross-sectional view of the essential portion of the fixing device 100 as seen from the right side when the bottom belt assembly is free of pressure. FIG. 5 is a left side view of the essential portion of the fixing device 100 when the bottom belt assembly B is under pressure. FIG. 6 is a perspective view of the belt deviation control mechanism.

Regarding the dimension of the fixing device 100 as well as the structural components of the fixing device 100, the lengthwise direction means the direction (or measurement) perpendicular to the direction V in which a sheet S of the recording medium is conveyed through the sheet conveyance passage of the fixing device 100, whereas the widthwise direction (dimension) means the direction (dimension) that is parallel to the direction V in which the sheet S is conveyed through the sheet conveyance passage of the fixing device 100.

The front side of the fixing device 100 is the sheet entrance side of the fixing device 100. The rear side of fixing device 100 is the sheet exit side of the fixing device 100. The left and right sides of the fixing device 100 are the left and right sides of the fixing device 100 as seen from the front side. In this embodiment, the left side is the same as the front side, and the right side is the same as the rear side. The top and bottom sides are the top and bottom sides with reference to the gravity direction. The upstream and downstream directions are with reference to the direction V in which a sheet S of the recording medium is conveyed. Further, the width of a belt or a sheet is the measurement of the belt or sheet, in terms of the direction perpendicular to the sheet conveyance direction.

The fixing device 100 in this embodiment is an image heating device of the so-called belt-nip type. Further, it is of the so-called electromagnetic induction heating type (IH), and also, oil-less fixation type.

This fixing device 100 has: a top belt assembly A as a heating unit; the bottom belt assembly B as a pressure applying unit; and a bottom assembly moving mechanism (means for placing bottom belt assembly B in contact with, or separating bottom belt assembly B from, top belt assembly A). It has also: an IH heater 170 (magnetic flux generating means), which is a heating means for heating the fixation belt 105 of the top belt assembly A; a belt deviation control mechanism for controlling the lateral deviation of the fixation belt 105 in; a roughening mechanism (surface property restoration mechanism) for restoring the fixation belt 105 in surface properties; etc. Hereafter, these components are described one by one.

(2-1) Top Belt Assembly A and IH Heater 170

The top belt assembly A is disposed between the left and right top plates of the frame of the fixing device 100. This assembly A has the fixation belt 105 (endless belt), as a rotational fixing member (fixing member: first rotational fixing member), the outward surface layer of which is a release layer, which faces the image bearing surface of a sheet S of the recording medium. It has also: multiple belt suspending members, more specifically, a driver roller 131 (supporting roller); a steering roller 132, which doubles as a tension roller; and a pad stay 137.

The driver roller 131 is disposed between the left and right top plates 140, and on the sheet outlet side of the fixing device 100. More specifically, the left and right end portions of the driver roller shaft 131*a* are rotatably supported by the left and right top plates 140, with the placement of a pair of bearings between the shaft 131*a* and two plates 140, one for one.

On the outward side of each of the left and right top plates 140, a steering roller support arm 154 is disposed, which extends from the driver roller 131 side toward the sheet entrance side. The right supporting arm 154 (unshown) is fixed to the right top plate 140 (unshown). Referring to FIG. 6, the left support arm 154 is supported by the left end of the shaft 131*a* of the driver roller 131, with the placement of a bearing 154*a* between the support arm 154 and shaft 131*a*, being enabled to pivot upward or downward about the shaft 131*a*. The unattached end of the left support arm 154 is provided with a pin 151, which was pressed into the arm 154. Further, the sheet entrance side of the outward surface of the left top plate 140 is provided with a shaft 160, which was pressed into the plate 140.

Further, the top belt assembly A is provided with a worm wheel 152 (helical gear) which is integral with a fork-shaped plate 161 having a U-shaped groove 161*a*, and which is pivotally supported by the shaft 160. Further, the pin 151 of the left support arm 154 is engaged in the groove 161*a* of the fork-shaped plate 161. The top belt assembly A is also provided with a stepping motor 155, which is attached to the top plate 140. A worm gear 157 fixed to the rotational shaft of the motor 155 meshes with the worm wheel 152.

As the stepping motor 155 is driven forward or in reverse, the fork-shaped plate 161 is pivotally moved upward or downward by the combination of worm gear 157 and worm wheel 152. Thus, the left support arm 154 pivotally moves upward or downward about the shaft 131*a*.

The steering roller 132 is disposed between the left and right top plates 140, and it is on the sheet entrance side of the fixing device 100. Further, the left and right ends of the shaft 132*a* are rotatably supported by the above-described left and right support arms 154, with the placement of a pair of bearings 153. Each bearing 153 is supported by the support arm 154 in such a manner that it is allowed to slide relative to the support arm 154 in the belt tension direction, and is under the force generated by a tension spring 156 in the direction to move the bearing 153 away from the driver roller 131.

The pad stay 137 is a component formed of stainless steel (SUS), for example. It is disposed on the inward side of the loop (belt loop) which the fixation belt 105 forms. In terms of the recording medium conveyance direction, it is disposed between the driver roller 131 and the steering roller 132, and is located next to the driver roller 131. In terms of the lengthwise direction of the fixing device 100, it is disposed between the left and right top plates 140. More specifically, its left and right ends are fixed to the left and right top plates 140, respectively, in such an attitude that its belt-backing surface faces downward.

The fixation belt 105 is suspended by the combination of the driver roller 131, the steering roller 132, and the pad stay 137, in such a manner that it bridges between the adjacent two of the components 131, 132, and 137. It is under a preset amount of tension generated by the force generated by a belt tension spring 156 (compression spring) in the direction to move the steering roller 132 away from the driver roller 131. The preset amount of force generated by the belt tension spring 156 in this embodiment is 200 N. The inward surface of the fixation belt 105, which corresponds to the bottom side of the belt loop, is in contact with the belt-backing surface (downwardly facing surface) of the pad stay 137.

As for a belt to be used as the fixation belt 105, it may be any belt as long as it can be made to electromagnetically generate heat, and is heat resistant. For example, the fixation belt 105 may be an endless belt consisting of: a magnetic metal layer, such as a metallic (nickel) layer, stainless steel layer, etc., which is 70 μm in thickness, 30 mm in width, and 200 mm in circumference; a silicon rubber layer coated on the outward surface of the metallic layer to a thickness of 300 μm, for example; and a surface layer (release layer) which is a piece of PFA tube fitted around the silicon rubber layer.

The driver roller 131 is made up of a metallic core, and an elastic layer molded around the metallic core. More specifically, the metallic core is a piece of solid stainless steel, for example, and 18 mm in diameter. The elastic layer is formed of heat resistant silicon rubber. In terms of the recording medium conveyance direction, the driver roller 131 is disposed on the sheet exit side of the nip formed by the combination of the fixation belt 105, and the pressure roller 120 as the second rotational fixing member (which will be described layer). As the pressure roller 121, which will be described layer, is pressed against the driver roller 131, the elastic layer of the driver roller 131 is elastically deformed by a preset amount.

As for the shape of the nip, which is formed between the driver roller 131 and the pressure roller 121 with the presence of the fixation belt 105 between the two rollers 131 and 121, it is roughly straight. However, from the standpoint of preventing a sheet S of the recording medium from buckling due to the non-uniformity of the nip, in terms of the lengthwise direction of the nip, in the recording medium conveyance speed, the shape of the driver roller 131 and the pressure roller 121 may be made different from those in this embodiment. For example, the two rollers 131 and 121 may be shaped so that in terms of the sectional view parallel to their axial line, their peripheral surface negatively crowns.

The steering roller 132 is a hollow roller. It is formed of stainless steel, for example, and is roughly 20 mm in external diameter, and 18 mm in internal diameter. The steering roller 132 functions as a tension roller, which provides the fixation belt 105 with tension. Moreover, it functions as a steering roller, whose angle is controlled by a belt deviation control mechanism, which will be described later, to prevent the fixation belt 105 from excessively deviating in its widthwise direction, that is, the direction perpendicular to the moving direction of the fixation belt 105.

The driver roller 131 is fitted with a driving force input gear G. More specifically, the driving force input gear G is fixed to the left end of the shaft 131*a* of the driver roller 131, in such a manner that the shaft 131*a* and the gear G become coaxial. To this gear G, the driving force is inputted from a driving motor 301 (FIG. 2) through a driving force transmitting means (unshown), whereby the driver roller 131 is rotationally driven in the clockwise direction indicated by an arrow mark in FIG. 3 at a preset speed.

As the driver roller 131 is rotationally driven, the fixation belt 105 is circularly moved by the rotation of the driver roller 131 in the clockwise direction indicated by the arrow mark at a speed which corresponds to the speed of the driver roller 131. As for the steering roller 132, it is rotated by the circular movement of the belt 105. The fixation belt 105 is made to move circularly, with the inward surface of the portion of the fixation belt 105, which corresponds to the bottom side of the belt loop, sliding on the belt-backing surface, that is, the downwardly facing surface, of the pad stay 137, in order to ensure that the driving force is reliably transmitted to the fixation belt 105 so that a sheet S of the recording medium is reliably conveyed through the fixation nip N, which will be described later.

The IH heater 170 as a heating means for heating the fixation belt 105 is a magnetic induction heating coil unit. It is made up of an excitation coil, a magnetic core, a holder for holding the coil and the core, etc. It is disposed on the top side of the top belt assembly A, in such a manner that a preset amount of a gap is provided between the IH heater 170 and the portion of the fixation belt 105, which corresponds to the combination of the top portion of the belt loop and the steering roller 132. It is disposed between the left and right top plates 140, with its left and right ends fixed to the left and right top plates 140, respectively.

As the excitation coil of the IH heater 170 is supplied with alternating electric current, it generates an alternating magnetic flux, which is guided to the magnetic metallic layer of the fixation belt 105, which is an inductive heat generating member, by the magnetic core. Thus, an eddy current is induced in the magnetic metallic layer. This eddy current generates Joule's heat in the magnetic metallic layer, because of the presence of the specific electrical resistance of the inductive heat generating member. The alternating electric current to be supplied to the excitation coil is controlled by the CPU 10 based on the temperature information from a thermistor 220 for detecting the surface temperature of the fixation belt 105, in such a manner that the surface temperature of the fixation belt 105 remains within a range of roughly 140-200° C. (target range).

(2-2) Bottom Belt Assembly Band Mechanism for Pressing Bottom Belt Assembly B Upon Top Belt Assembly A or Separating Bottom Belt Assembly B from Top Belt Assembly A The bottom belt assembly B is disposed on the bottom side of the top belt assembly A. It is attached to the bottom frame 306 (pressure application frame) which is supported by the shaft 304 fixed to the sheet exit side of the left and right bottom plates 303 of the fixing device 100, in such a manner that it is pivotally movable upward or downward about the shaft 304.

This assembly B has the flexible pressure belt 120 (endless belt) as a rotational fixing member (pressure applying member: second rotational fixing member) which forms the nip between itself and the fixation belt 105 of the top belt assembly A. Further, it has the pressure roller 121 (pressure roller) and the tension roller 122, as belt suspending members, by which the pressure belt 120 is suspended and kept tensioned, and the pressure pad 125.

The left and right ends of the shaft 121*a* of the pressure roller 121 are disposed between the left and right lateral plates of the bottom frame 306, and are rotatably supported by the left and right plates, with the placement of a pair of bearings 159 between the shaft 121*a* and left and right plates, one for one. The left and right ends of the shaft 122*a* of the tension roller 122 are rotatably supported by the left and right plates of the bottom frame 306, with the placement of a pair of bearings 158 between the shaft 122*a* and the left and right plates, one for one. Each bearing 158 is supported by the bottom frame 306 in such a manner that it is allowed to slide on the bottom frame 306 in the belt tension direction, and is under the force generated by the belt tension spring 127 (compression spring) in the direction to move the bearing 158 away from the pressure roller 121.

The pressure pad 125 is formed of a silicon rubber, for example. It is disposed between the left and right plates of the bottom frame 306, and its left and right ends are fixed to the left and right plates of the bottom frame 306, respectively, being thereby supported by the bottom frame 306. The pressure roller 121 is disposed between the left and right plate of the bottom frame 306. In terms of the recording medium conveyance direction, the pressure roller 121 is on the sheet exit side of the nip N. As for the tension roller 122, it is disposed between the left and right plates of the bottom frame 306, and is on the sheet entrance side of the fixing device 100. The pressure pad 125 is non-rotationally disposed on the inward side of the pressure belt loop. It is between the pressure roller 121 and the tension roller 122, being positioned next to the pressure roller 121, with its belt supporting surface facing upward.

The pressure belt 120, which is supported by the pressure roller 121, the tension roller 122, and the pressure pad 125 in such a manner that it bridges between the adjacent two components 121, 122 and 125. It is provided with a preset amount of tension by the tension roller 122, which is under the force generated by a belt tension spring 127 (compression spring) in the direction to move the tension roller 122 away from the pressure roller 121. In this embodiment, the preset amount of tension is 200 N. The pressure belt 120 is in contact with the upwardly facing surface of the pressure pad 125 by the inward surface of its top portion with reference to the loop which the pressure belt 120 forms.

A belt that is to be used as the pressure roller 121 may be any belt, as long as it is heat resistant. For example, it may be an endless belt comprising: a metallic (nickel, for example) layer which is 50 μm in thickness, 30 mm in width, and 200 mm in circumference; a silicon rubber layer coated on the peripheral surface of the metallic layer; and a surface layer, which is a piece of PFA tube fitted around the silicon rubber layer. The pressure roller 121 is a solid stainless roller, which is 20 mm in external diameter, for example. The tension roller 122 is a hollow roller which is formed of stainless steel, for example, and is roughly 20 mm in external diameter, and 18 mm in internal diameter.

The bottom belt assembly B is pivotally movable about the shaft 304 in the upward or downward direction by the bottom belt assembly moving mechanism as the means for placing the bottom assembly B in contact with the top belt assembly A or separating the bottom belt assembly B from the top belt assembly A. That is, the bottom belt assembly B is pivotally movable upward by the belt assembly moving mechanism into a pressure application position as shown in FIG. 3, or downward into the noncontact position as shown in FIG. 4.

As the bottom belt assembly B is moved to its pressure application position, the pressure roller 121 and the pressure pad 125 are pressed against the driver roller 131 and the pad stay 137, respectively, of the top belt assembly A, by a preset amount of pressure, with the pressure belt 120 and the fixation belt 105 pinched between the combination of the pressure roller 121 and the pressure pad 125 and the combination of the driver roller 131 and the pad stay 137. Thus, the fixation nip N, which has a preset width, in terms of the direction V in which a sheet S of the recording medium is conveyed, is formed between the fixation belt 105 of the top belt assembly A and the pressure belt 120 of the bottom belt assembly B. On the other hand, as the bottom belt assembly B is moved to its noncontact position, the pressure belt 120 is separated from the fixation belt 105, and the preset amount of pressure applied to the top belt assembly A by the bottom belt assembly B is eliminated.

Next is described the above-mentioned mechanism for moving the bottom belt assembly B in this embodiment. The bottom frame 306 is provided with a compression spring unit which is on the opposite side of the bottom frame 306 from the shaft 304. The compression spring unit is provided with a compression spring 305 for keeping the bottom belt assembly B elastically in contact with the top belt assembly A.

There is a pressure application cam shaft 307 between the bottom portions of the left and right plate 303, being rotatably borne by a pair of bearings. To the left and right ends of this pressure application cam shaft 307, a pair of eccentric pressure application cams 308, which are for pressing the bottom frame 306 by the bottom surface, and which are the same in shape, are fixed so that they become the same in rotational phase. To the left end of the pressure application cam shaft 307, a pressure application gear 30 (FIG. 2) is coaxially fixed. To this gear 309, a driving force is inputted from a pressure application motor 302 through a driving force transmitting means, whereby the pressure application cam shaft 307 is rotationally driven.

The rotation of the pressure application cam shaft 307 is controlled so that it is moved into the first angular position in which the largest radius portion of the cam 308 points upward as shown in FIGS. 3 and 5, or the second angular position in which the largest radius portion of the cam 308 points downward as shown in FIG. 4.

As the pressure application cam shaft 307 is moved into the first angular position, and stopped there, the bottom frame 306, which holds the bottom belt assembly B, is lifted by the largest radius portion of the eccentric pressure application cam 308. Thus, the bottom belt assembly B is placed in contact with the top belt assembly A while compressing the compression spring 305 of the pressure application spring unit. Thus, the bottom belt assembly B is elastically pressed upon the top belt assembly A by a preset amount of pressure (400 N, for example) generated by the resiliency of the compression spring 305, and is held in the pressure application position shown in FIG. 3.

Here, as the pressure roller 121 is pressed against the driver roller 131, the driver roller 131 bends in the opposite direction from the pressure roller 121 by roughly several hundreds of microns. This bending of the fixation roller 101 is the primary cause of the problem that the center portion of the fixation nip N in terms of the lengthwise direction of the nip is weaker in internal pressure than the rest. In this embodiment, therefore, in order to prevent this problem, the driver roller 131, or both the driver roller 131 and the pressure roller 121 are shaped so that in terms of their cross-sectional view, their peripheral surface bows outward to ensure that the nip, which the driver roller 131 and the pressure roller 121 form, becomes roughly straight. In this embodiment, the driver roller 131 is shaped so that its peripheral surface bows outward by 300 μm in terms of its cross sectional view.

On the other hand, as the pressure application cam shaft 307 is rotated into the second angular position, and is stopped there, the largest radius portion of the eccentric pressure application cam 308 points downward, and the smallest radius portion of the eccentric pressure application cam 308 points upward. Thus, the bottom belt assembly B is lowered by the resiliency of the compression spring 305. That is, the bottom belt assembly B is moved away from the top belt assembly A, and is held in the noncontact position shown in FIG. 4, being separated from the top belt assembly A in a preset manner.

Figure 7A:
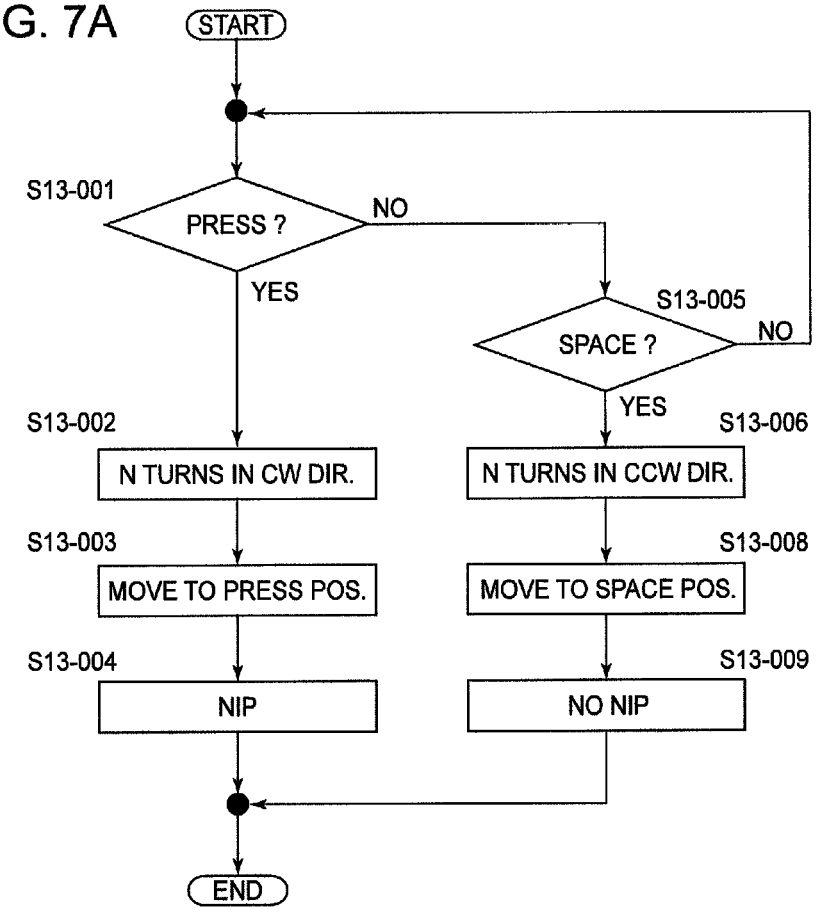
FIG. 7A is a flowchart of the control sequence for vertically moving the bottom belt assembly.
Figure 7B:
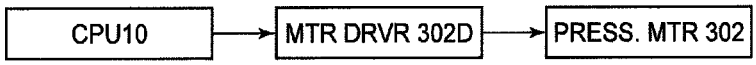
FIG. 7B is a block diagram of the control system.

Next, referring to the control flowchart in FIG. 7A, and the block diagram of the control system in FIG. 7B, the control sequence for moving the bottom belt assembly B upward or downward is described.

When the printer 1 is not in operation, the bottom belt assembly B is held in the noncontact position shown in FIG. 4. As a pressure application command is issued by the CPU 10 <S13-001>, the pressure application motor 302 is rotated by the motor driver 302D in the CW direction by a preset number N of times <S13-002>, whereby the pressure application cam shaft 307 is rotationally driven by half a turn. Thus, the angular position of the eccentric pressure application cam 308 is changed from the second angular position shown in FIG. 4 to the first angular position shown in FIGS. 3 and 5, whereby the bottom belt assembly B is pivotally moved upward. Thus, the the pressure roller 121 and the pressure pad 125 are moved into their pressure application positions <S134-003>.

That is, the pressure roller 121 and the pressure pad 125 are pressed against the driver roller 131 and the pad stay 137 of the top belt assembly A, respectively, by the preset amount of pressure, with the presence of the pressure belt 120 and the fixation belt 105 being pinched between the combination of the pressure roller 121 and the pressure pad 125 and the combination of the driver roller 131 and the pad stay 137. Thus, the fixation nip N having the preset width in terms of the sheet conveyance direction V is formed between the fixation belt 105 and the pressure belt 120<S13-004>.

On the other hand, as a separation command is issued by the CPU 10 when the bottom belt assembly B is held in the pressure application position shown in FIG. 3<S13-005>, the pressure application motor 302 is rotated a preset number N of times in the CCW direction by the motor driver 302D <S13-006>. Thus, the pressure application cam shaft 307 is rotationally driven by half a turn, whereby the eccentric pressure application cam 308 is moved from the first angular position shown in FIGS. 3 and 5 to the second angular position shown in FIG. 4. Thus, the bottom belt assembly B is pivotally moved downward, whereby the pressure roller 121 and the pressure pad 125 are moved into their separation positions <S13-008>. Thus, the fixation nip N vanishes <S13-009>.

(2-3) Fixing Operation and Temperature Control

Figure 9A:
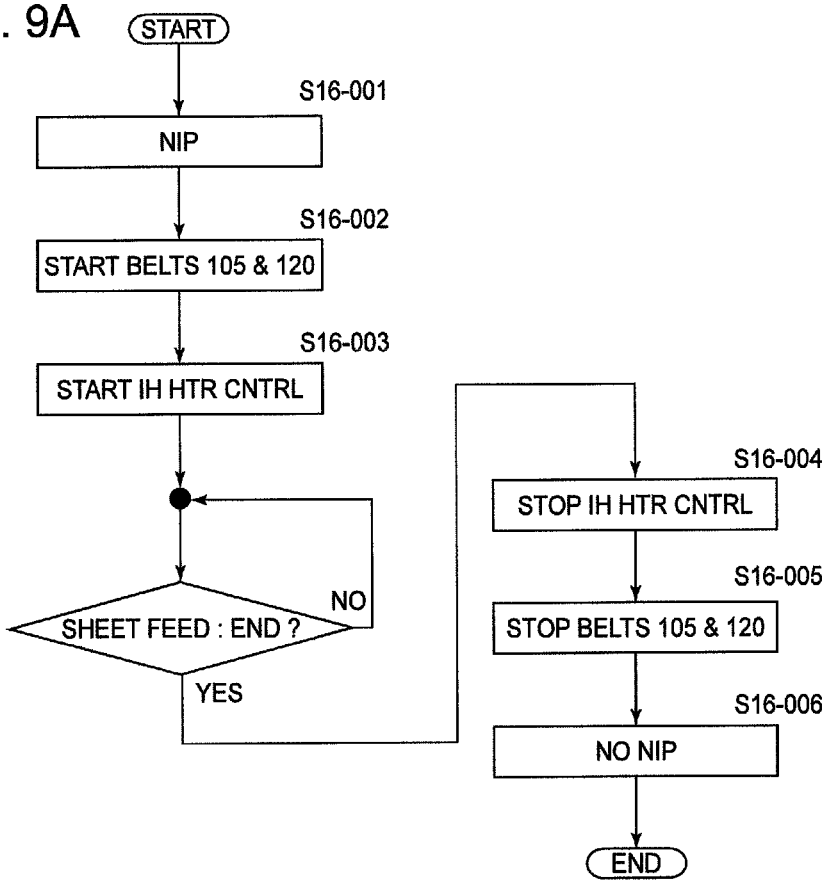
FIG. 9A is a flowchart of the fixing operation control sequence of the fixing device.
Figure 9B:
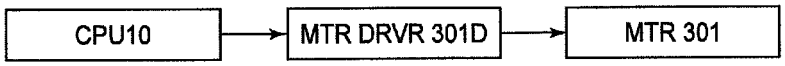
FIG. 9B is a block diagram of the control system.

Next, referring to the control flowchart in FIG. 9A, and the block diagram of the control system in FIG. 9B, the fixing operation of the fixing device 100 is described. When the fixing device 100 is kept on standby, the bottom belt assembly B is held in the noncontact position, and the driving motor 301 is kept stationary. Further, the IH heater 170 is not supplied with electric power.

The CPU 10 begins the preset image formation sequence in response to the inputting of a printing job start signal. Regarding the fixing device 100, the CPU 10 drives the pressure application motor 302 with the use of the motor driver 302D with a preset control timing to rotationally drive the pressure application cam shaft 307 by half a turn, thereby causing the bottom belt assembly B to move from the noncontact position shown in FIG. 4, into the pressure application position shown in FIG. 3. Thus, the fixation nip N is formed between the fixation belt 105 and pressure belt 120 <S16-001>.

Next, the CPU 10 instructs inputting of the driving force into the driving force input gear G by driving the driving motor 301 with the use of motor driver 302D. Thus, the driver roller 131 of the top belt assembly A begins to be rotated, and therefore, the fixation belt 105 begins to circularly move.

Further, the rotational force of the driving force input gear G is transmitted to the pressure roller 121 of the bottom belt assembly B, through a driving force transmitting gear train (unshown). Thus, the pressure roller 121 is rotationally driven in the counterclockwise direction indicated by an arrow mark in FIG. 3. As the pressure roller 121 rotates, the pressure belt 120 begins to be circularly moved in the counterclockwise direction indicated by an arrow mark by the friction between the pressure belt 120 and the fixation belt 105 <S16-002>. The direction in which the fixation belt 105 moves in the fixation nip N and the direction in which the pressure belt 120 moves in the fixation nip N are the same, and the speed at which the fixation belt 105 moves in the fixation nip N, and the speed at which the pressure belt 120 moves in the fixation nip N are roughly the same.

Next, the CPU 10 increases the temperature of the rotating fixation belt 105 to a preset level (target level), and maintains the temperature at the target level, by heating the fixation belt 105 by magnetic induction by supplying the IH heater 170 with electrical power with the use of the heater controller 170C (FIG. 8B) and the heater driver 170D. More specifically, the CPU 10 begins the temperature control sequence which increases the temperature of the fixation belt 105 to the target level, which is in a range of 140 degrees to 200 degrees, and maintains it at the target level, according to the basis weight of a sheet S of the recording medium, paper type, etc., which is conveyed through the printer 1 (fixing device 100) <S16-003>.

Then, as soon as the nip N is formed, the belts 105 and 120 begin to be circularly moved, and the temperature of the belt 105 is increased to, and begins to be maintained at, the target level, a sheet S of the recording medium having an unfixed toner image t (FIG. 3) on its upwardly facing surface is guided into the fixing device 100. More concretely, the sheet S enters the fixation nip N, that is, the area of contact between the fixation belt 105 and the pressure roller 121, while being guided by the entrance guide 184 which is at the sheet entrance of the fixing device 100. The entrance guide 184 is provided with a flag sensor 185 having a photo-interrupter, to detect the sheet conveyance timing.

The sheet S of the recording medium is conveyed through the fixation nip N, remaining pinched by the fixation belt 105 and the pressure belt 120, in such an attitude that its image bearing surface faces the fixation belt 105, and its opposite surface from the image bearing surface faces the pressure belt 120. Thus, the unfixed toner image t on the sheet S is fixed as a permanent image to the sheet S by the heat from the fixation belt 105 and the nip pressure. After the sheet S is conveyed through the fixation nip N, it is separated from the surface of the fixation belt 105, and comes out of the sheet exit side the fixing device 100. Then, it is conveyed further, and discharged into the delivery tray 21, by the pair of discharge rollers 20 (FIG. 1).

As soon as the last sheet S of the recording medium in a printing job for outputting a single print, or multiple prints, is conveyed, the CPU 10 stops heating (fixation belt temperature control sequence), and stops supplying the IH heater 170 with electric power <S16-004>. Further, it stops the circular movement of the fixation belt 105 and the pressure belt 120 by turning off the driving motor 301<S16-005>.

Further, the CPU 10 moves the bottom belt assembly B from the pressure application position shown in FIG. 3 to the noncontact position shown in FIG. 4 by rotationally driving the pressure application cam shaft 307 half a turn by driving the pressure application motor 302 with the use of the motor driver 302D. Thus, the fixation nip N between the fixation belt 105 and the pressure belt 120 vanishes <S16-006>. Then, the CPU 10 waits for the inputting of the next print job start signal.

Figure 8A:
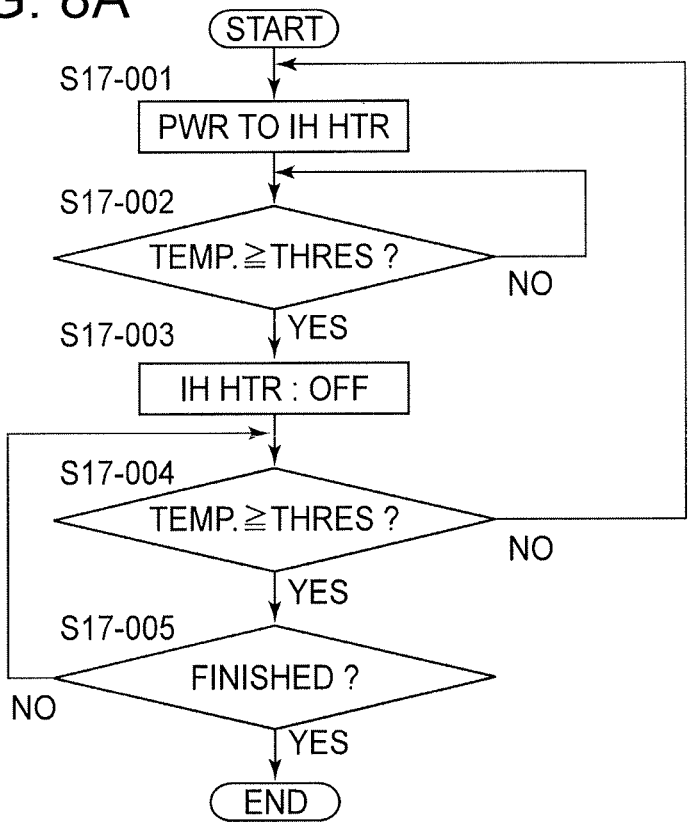
FIG. 8A is a flowchart of the fixation belt temperature control sequence.
Figure 8B:
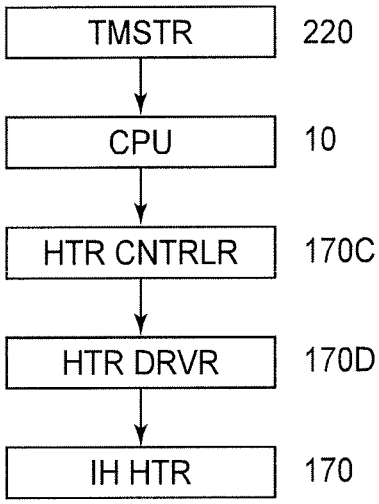
FIG. 8B is a block diagram of the control system.

Next, referring to the control flowchart in FIG. 8A, and the block diagram of the control system in FIG. 8B, the temperature control of the fixation belt 105 is described. The top belt assembly A is equipped with the thermistor 220 as a temperature detecting member for detecting the surface temperature of the fixation belt 105. The CPU 10 begins to supply the IH heater 170 with electric power through the heater controller 170C and the heater driver 170D, with a preset control timing, in response to the inputting of a print job start signal <S17-001>. Thus, the fixation belt 105 is increased in temperature by the heat which is electromagnetically induced in the fixation belt 105 by the IH heater 170.

The temperature of the fixation belt 105 is detected by the thermistor 220, and the detected temperature information (electrical information of temperature) is inputted into the CPU 10. If the temperature detected by the thermistor 220 is higher than a preset value (target temperature value), the CPU 10 stops supplying the IH heater 170 with electric power <S17-003>. Then, as the temperature detected by the thermistor 220 falls below the preset value <No in S17-004>, the CPU 10 begins to supply the IH heater 170 with electric power again <S17-001>.

By the repetition of the above-described steps <S17-001>-<S17-004>, the temperature of the fixation belt 105 is maintained at the preset target level (target temperature). The above-described fixation belt temperature control is continued until the printing job in which a single print, or multiple prints are to be outputted ends <S17-005>.

(2-4) Mechanism for Controlling Belt Deviation

The fixation belt 105 suffers from a phenomenon (lateral deviation of belt) that as it is circularly driven, it deviates in its widthwise direction, that is, the direction perpendicular to the sheet conveyance direction. As this phenomenon occurs, the pressure belt 120, which forms the fixation nip N by being pressed upon the fixation belt 105, also deviates along with the fixation belt 105.

In this embodiment, the lateral deviation of the fixation belt 105 is controlled with the use of a belt deviation control of the so-called swing type, so that the lateral movement of the fixation belt 105 remains within a preset range. The belt deviation control of the swing type is such a controlling method that as it is detected that the fixation belt 105 has deviated from its central position, in terms of its widthwise direction, by a preset amount, the steering roller 132 is tilted in the opposite direction from the direction of the belt deviation. Repeating this belt deviation control causes the fixation belt 105 to periodically move back and forth in the widthwise direction in a preset range, and therefore, can stabilize the fixation belt 105 in its lateral movement. That is, the fixing device 100 is structured so that the fixation belt 105 is allowed to swing in the direction perpendicular to the direction V in which a sheet S of the recording medium is conveyed.

The top belt assembly A is provided with a sensor (unshown) which is disposed on the left (front) side of the fixation belt 105 to detect the position of the left edge of the fixation belt 105 relative to the steering roller 132. The CPU 10 detects the position (belt deviation position) of the left edge of the fixation belt 105 with the use of this sensor, and rotates a stepping motor 155 in the positive (CW), or negative (CCW), direction, according to the detected position of the left edge of the fixation belt 105, by a preset number of times.

Thus, the left steering roller support arm 154 is pivotally moved upward or downward about the shaft 131*a* by the combination of the above-described mechanisms 157, 152, 161 and 151 shown in FIGS. 5 and 6, by a preset control amount. Thus, the angle of the steering roller 132 is changed, and therefore, the fixation belt 105 is controlled in its deviation.

(2-5) Mechanism for Roughening Fixation Belt 105

Figure 10A:
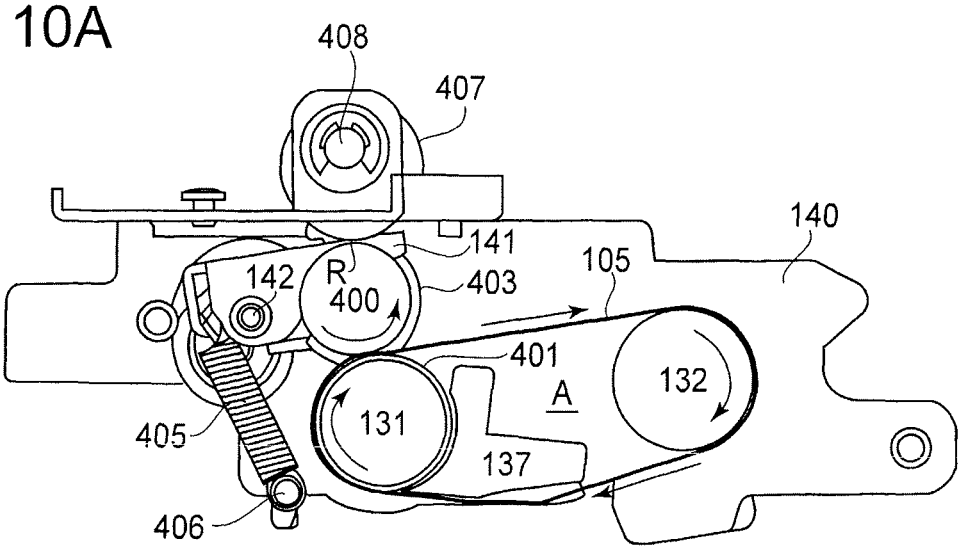
FIGS. 10A and 10B are drawings for illustrating the roughening mechanism (surface property restoration mechanism).
Figure 10B:
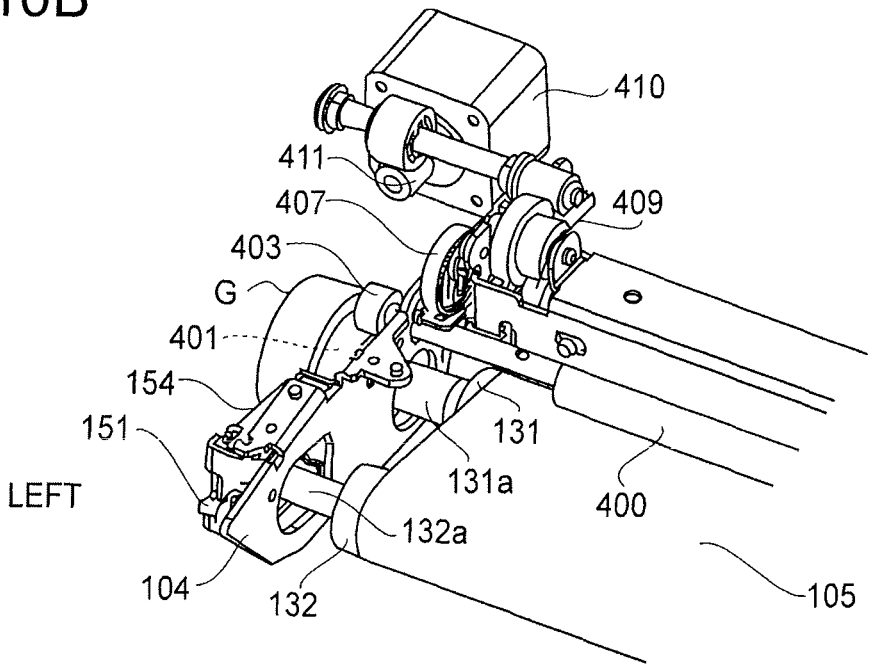

Next, referring to FIGS. 10A and 10B, a roughening mechanism (surface property restoration mechanism) for restoring the surface properties of the fixation belt 105 is described. In this embodiment, the fixing device 100 is provided with a rotational abrading member (roughening member) for abrading the outward surface of the fixation belt 105 to restore the surface properties of the fixation belt 105, which is located above the driver roller 131 of the top belt assembly A. As described above, this roughening roller is such a roller that is effective to restore the surface properties of the fixation belt 105 in a case where the portions of the outward surface of the fixation belt 105, with which the lateral edges of a sheet S of the recording medium come into contact, become rougher in texture than the rest.

That is, the roughening roller 400 is such a roller that is used to roughly rub the entirety of the outward surface of the fixation belt 105, in terms of the lengthwise direction, to make the portions of the outward surface of the fixation belt 105, which have been made rougher in texture by the sheet edges, roughly the same in surface texture, as the portions of the outward surface of the fixation belt 105, which have not been contacted by the sheet edges, in order to make inconspicuous the surface deterioration of the fixation belt 105. In this embodiment, this process is referred to as "surface property restoration".

More concretely, as the surface texture of the above-described portions of the outward surface of the fixation belt 105 deteriorate to roughly 2.0 in surface roughness Rz, the outward surface of the fixation belt 105 are roughened (abraded) by the roughening (abrading) roller 400 to restore the outward surface of the fixation belt 105 in surface texture to 0.5-1.0 in surface roughness Rz. More specifically, in a case where the difference ΔRa in surface roughness Rz between the portions of the outward surface of the fixation belt 105, which have come into contact with the edges of a sheet S of the recording medium, and the rest of the outward surface of the fixation belt 105, becomes roughly 0.3, the outward surface of the fixation belt 105 is roughened (abraded) to reduce the difference ΔRa to roughly 0.1.

Although, in this member, the roller used in this embodiment to restore the fixation belt 105 in surface texture is referred to as "roughening roller 400", the role of the roughening roller 400 is to keep the surface roughness of the outward surface of the fixation belt 105 satisfactorily low for a long time. Keeping the surface roughness of the outward surface of the fixation belt 105 satisfactorily low is closely related to the prevention of an image forming apparatus from outputting images which are non-uniform in gloss and unsatisfactorily low in gloss.

The roughening roller 400 is rotatably supported between the pair of left and right RF support arms 141. More concretely, the pair of left and right RF support arms 141 are pivotally and coaxially supported by shaft 142, which is fixed to the left and right top plates 140 of the frame of the fixing device 100, and the roughening roller 400 is rotatably supported by the pair of left and right RF support arms 141 with the placement of a pair of bearings (unshown) between itself and the arms 141.

The roughening roller 400 is made up of a metallic core, and abrasive particles which are densely adhered to the peripheral surface of the metallic core with the use of adhesive. The metallic core is formed of stainless steel, and is 12 mm in diameter. It is desired that abrasive is selected according to the target level of gloss for an image to be formed. That is, the abrasive is desired to be in a range of #1,000-#4,000 in particle size. Regarding the average particle diameter of the abrasive, particulate (grain size) abrasive that is #1,000 in particle size is roughly 16 μm in average particle diameter, and particulate abrasive that is #4,000 in particle size is roughly 3 μm in average particle size.

The particulate abrasive in this embodiment is based on alumina (called Alundum or Morundum). Alumina-based particulate abrasive is most widely used for industrial purposes. It is extremely hard compared to the surface of the fixation belt 105, and is angular in particle shape, being therefore excellent in abrasiveness. In this embodiment, a particulate abrasive which is #2,000 in particle size (7 μm in average particle diameter) is used.

By the way, the roughening roller 400 in this embodiment was formed by densely adhering particulate abrasive to the metallic (stainless) core with the use of adhesive. However, this embodiment is not intended to limit the present invention in scope in terms of roughening roller selection. For example, the roughening roller 400 may be such a roller that is made by uniformly blasting the peripheral surface of the metallic (stainless) core to make the peripheral surface of the metallic core roughly 1.0-5.0, preferably, 2.0-4.0, in surface roughness.

(2-6) Mechanism for Placing Roughening Roller in Contact with, or Separating Roughening Roller from, Fixation Belt The fixing device 100 in this embodiment is provided with a mechanism (moving mechanism) for placing the roughening roller 400 in contact with, or separating the roughening roller 400 from, the fixation belt 105. Hereafter, this mechanism is concretely described. The fixing device 100 is structured so that when the printer 1 (fixing device 100) is in the mode in which the fixation belt 105 is to be abraded, the lengthwise ends of the shaft of the roughening roller 400 are kept pressed toward the fixation belt 105 by a pressing mechanism. In this embodiment, the left and right RF support arms 141, which will be described later, bear the role of this pressing mechanism.

There are disposed a pair of RF cams (eccentric cams) 407 on the top side of the left and right RF support arms 141, one for one. The left and right RF cams 147 are the same in shape, and are fixed to the left and right ends of the RF cam shaft 408, which is rotatably supported between and by the left and right top plates 140 of the frame of the fixing device 100, with the placement of a pair of bearing between the RF cam shaft 408 and the left and right plates 140, respectively, in such an attitude that the two cams 147 remain the same in rotational phase. Regarding the left and right RF support arms 141, an RF separation spring 405 is disposed to be stretched between the opposite end of each of the left and right RF support arms 141 from the end by which the roughening roller 400 is supported, and an RF separation shaft 406 is fixed to the corresponding top plate 140.

Thus, the left and right RF support arms 141 always remain under the force generated by the tension of the RF separation spring 405 in the direction to cause the corresponding RF support arm 141 to pivotally move about the shaft 142 in the direction to move the roughening roller 400 upward. Thus, the top surface of each of the left and right RF arm is made to remain in contact with the downwardly facing portion of the peripheral surface of the corresponding RF cam 407, by the force generated by the tension of the RF separation spring 405. Referring to FIG. 10B, to the right end of the RF cam shaft 408, an RF moving gear 409 is fixed. This RF moving gear 409 meshes mesh with the RF motor gear 411 of the RF motor 410.

In this embodiment, when the surface properties of the fixation belt 105 do not need to be restored, the left and right RF cams 407 are kept stationary in their first attitude, in terms of their rotational phase, in which their largest radius portion points upward, as shown in FIGS. 3 and 4. When the left and right RF cams 407 are in this state, the left and right RF support arms 141 are facing the smallest radius portion of the corresponding RF cam 407. Therefore, the roughening roller 400 remains in the noncontact position, which keeps the roughening roller 400 separated from the fixation film 23 by a preset distance (FIGS. 3 and 4). That is, the roughening roller 400 remains upwardly separated from the fixation belt 105 by the preset distance. Therefore, it does not act on the fixation belt 105.

When it is necessary to restore the surface properties of the fixation belt 105, the left and right RF cams 407, which have been kept in the above-described first attitude, are rotated 180° into the second attitude in terms of rotational phase, in which their largest radius portion points downward as shown in FIG. 10B, and then, are held in the second attitude. As the left and right RF cams 407 are rotated as described above, the left and right RF support arms 141 are pivotally moved downward about the shaft 142 by the corresponding RF cams 407 against the resiliency of the RF separation springs 405. Thus, the roughening roller 400 is moved into, and held in, the pressure application position (contact position: FIG. 10A) in which it forms a roughening nip R by being pressed upon the outward surface of the portion of the fixation belt 105, which is in contact with the driver roller 131, by a preset amount of pressure.

Further, an RF gear 403 fixed to one of the lengthwise ends of the roughening roller 400 meshes with the RF driving gear 401 fixed to the corresponding end of the driver roller 131. Thus, the rotational force of the driver roller 131 is transmitted to the roughening roller 400 through the RF driving gear 401 and the RF gear 403. Thus, the roughening roller 400 rotates in the opposite direction from the fixation belt 105. That is, the roughening roller 400, the surface layer of which is an abrasive layer, has a function of uniformly roughening (evening in surface texture) the outward surface of the fixation belt 105, by rotating in the "width" direction (its peripheral surface moves in the same direction as fixation belt 105), in the abovementioned roughening nip R, with the presence of a certain amount of difference in peripheral velocity between itself and the fixation belt 105.

That is, the roughening roller 400, which is a rubbing (abrading) member, is such a roller that rotates at a peripheral velocity that is different from the peripheral velocity of the fixation belt 105. Regarding the switching of the position of the roughening roller 400 between the noncontact position and pressure application position, it is done by switching the attitude of the left and right RF support arms 141 between the first and second attitudes by rotating the RF motor gear 411, the RF moving gear 409, and the RF cam shaft 408 with the use of the RF pressing motor 410. By the way, FIG. 10A does not show the bottom belt unit B that forms the fixation nip N by being pressed upon the top belt unit A.

Figure 11A:
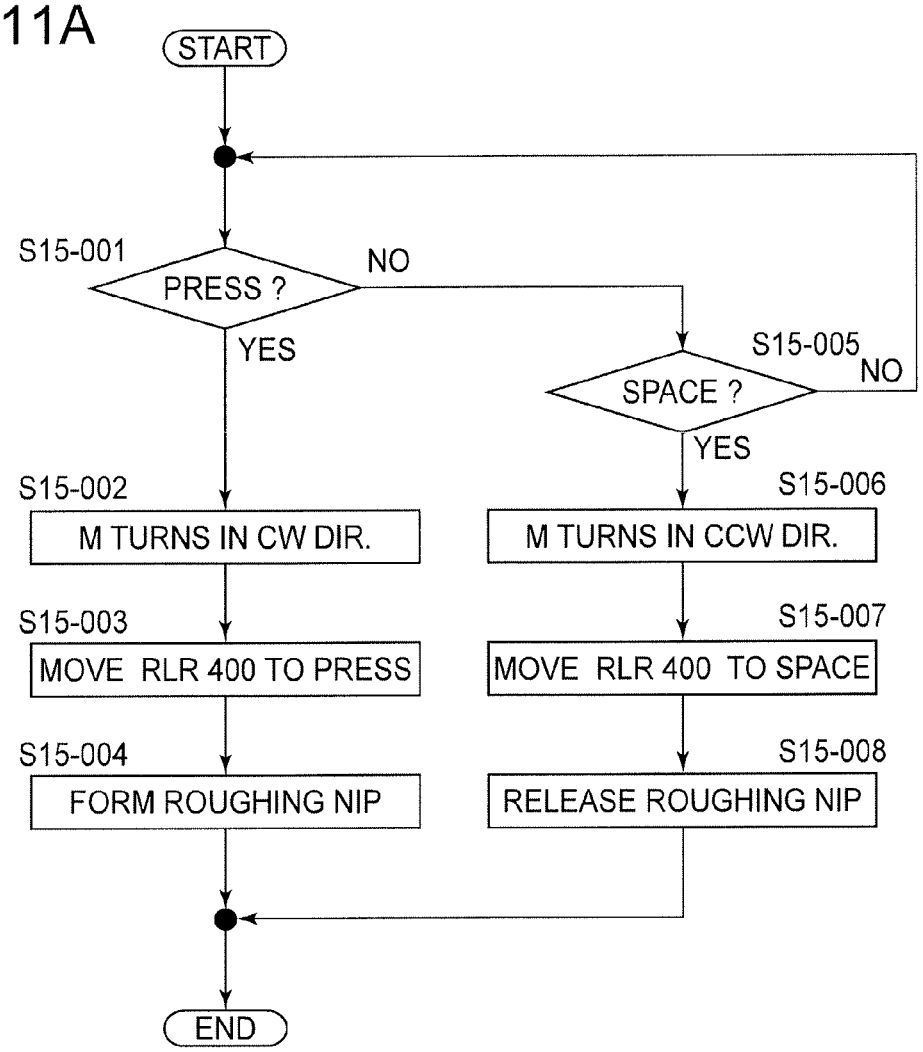
FIG. 11A is a flowchart of the roughening mechanism control sequence.
Figure 11B:
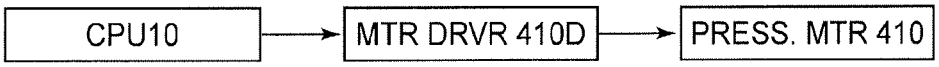
FIG. 11B is a block diagram of the control system.

FIG. 11A is a flowchart of the control sequence for the above-described roughening mechanism. When the fixing device 100 is not in the fixation belt roughening mode, the left and right RF cams 407 of the roughening mechanism are kept stationary in their first attitude, in terms of rotational phase, in which their largest radius portion points upward as shown in FIGS. 3 and 4. That is, the roughening roller 400 is held in the noncontact position, in which it remains separated from the fixation belt 105 by a preset distance.

The CPU 10 issues a pressure application command with a preset pressure application control timing <S15-001: pressure application command>, to rotate the RF pressing motor 410 in the CW direction by a preset number M of times through the motor driver 410D <S15-002>. Thus, the attitude of the left and right RF cams 407 are changed (position) from the first attitude (FIGS. 3 and 4) to the second attitude (FIG. 10A), whereby the roughening roller 400 is moved from the noncontact position (first position) to the pressure application position (second position <S15-003>. As the roughening roller 400 is moved into the pressure application position, it is pressed upon the fixation belt 105, and therefore, the roughening nip R is formed between the roughening roller 400 and the fixation belt 105 <S15-004>.

The CPU 10 issues a separation command with a preset separation control timing <S15-005: separation command> to rotate the RF pressing motor 410 in the CCW direction by a preset number M of times with the use of the motor driver 410D <S15-006>, whereby the attitude of the left and right RF cams 407 are switched (reversed) from the second attitude (FIG. 10A) to the first attitude (FIGS. 3 and 4), thereby causing the roughening roller 400 to be moved from the pressure application position to the noncontact position <S15-007>. As the roughening roller 400 is moved back into the noncontact position, the roughening nip N between the fixation belt 105 and the roughening roller 400 is made to vanish <S15-008>.

As described above, the roughening roller 400 is made to press on the outward surface of the fixation belt 105 to form the roughening nip N, and then, is rotated to restore the surface properties of the fixation belt 105. Thus, it is possible that as the outward surface of the fixation belt 105 is roughened, minute particles are generated from the surface layer of the fixation belt 105 in the roughening nip N. As these minute particles collect in the roughening nip N, the effectiveness of the roughening roller 400 is gradually reduced the roughening (abrading) process is reduced in effectiveness.

In order to prevent the minute particles resulting from the roughening of the outward surface of the fixation belt 105, from reducing the effectiveness of the roughening process, the fixing device 100 is configured so that during each roughening (abrading) sequence, the roughening roller 400 is made to shuttle twice or more times between the pressure application position and the noncontact position.

Figure 12:
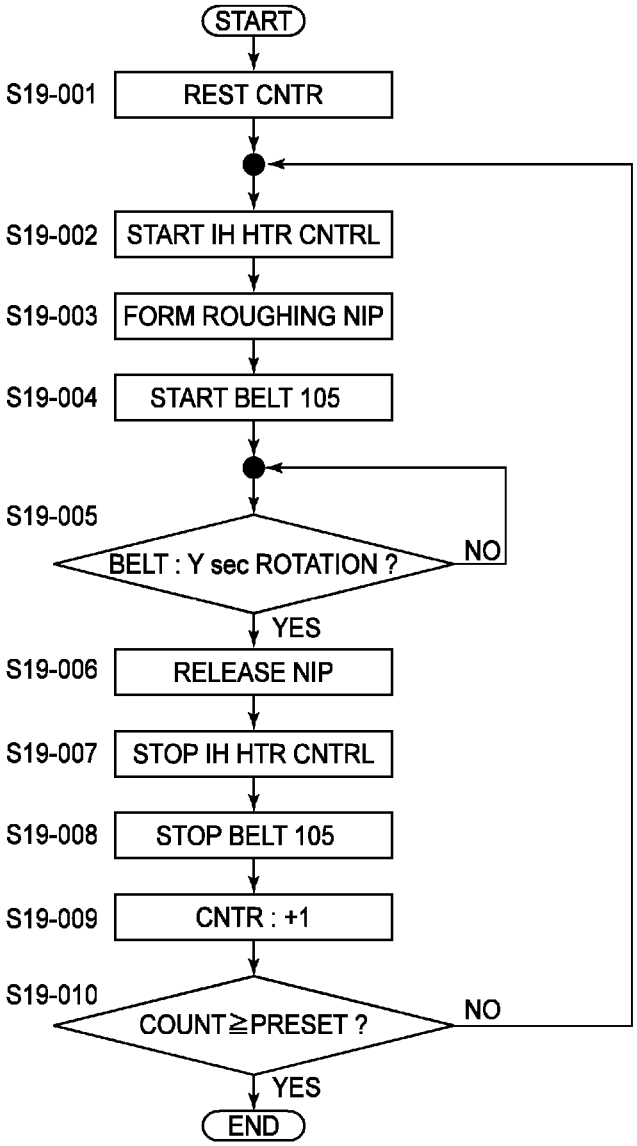
FIG. 12 is a flowchart of the surface property restoration sequence.
Figure 13:
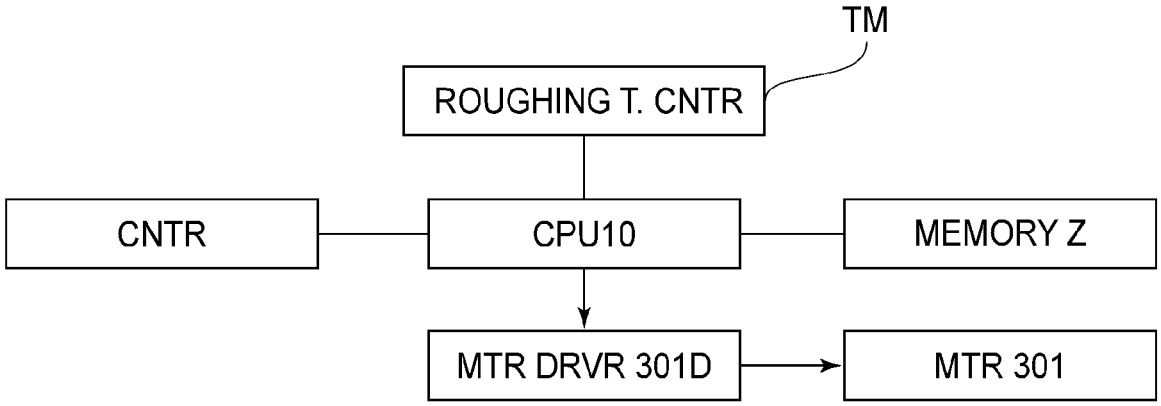
FIG. 13 is a block diagram of the surface property restoration control system.

Next, referring to FIGS. 12 and 13, this roughening (abrading) sequence is described. As the CPU 10 starts the roughening process (sequence), it resets a roughening operation counter CT to zero, and stores the value in the roughening operation counter CT, in a memory Z <S19-001>. Then, it begins to control the temperature of the fixation belt 105 with the use of the IH heater 170 to carry out the roughening process (abrading process) <S19-002>. This temperature control is based on FIGS. 8A and 8B.

As soon as the CPU 10 starts the temperature control, it forms the roughening nip N by causing the roughening roller 400 to press on the fixation belt 105 <S19-003>. Here, the formation of the fixation nip N is based on the sequence <S15-001>-<S15-004>. Then, it rotates the fixation belt 105 for a preset length Y of time (3 seconds in this embodiment) while measuring the length of time of the rotation with the use of a roughening time counter TM (FIG. 3) <S19-005>.

As soon as the fixation belt 105 is rotated for Y seconds, the CPU 10 moves the roughening roller 400 to the noncontact position (five seconds in separation time) to cause the roughening nip R to vanish. Here, the roughening nip R vanishes following the sequence <S15-005>-<S15-008>.

Then, the CPU 10 adds one (+1) to the value stored in the roughening operation counter CT, and ends the first roughening operation <S19-009>. Here, the roughening sequence <S19-002>-<S19-010> is repeated until the value in the roughening operation counter CT reaches a preset value (six times in this embodiment).

The above-described process is the roughening (abrading) sequence (process). This roughening sequence (abrading sequence) can improve the efficiency with which the surface properties of the outward surface of the fixation belt 105 are restored. In this embodiment, the roughening sequence (abrading sequence), which includes the length of time necessary to cause the roughening roller 400 to press on the fixation belt 105, and the length of time necessary to separate the roughening roller 400 from the fixation belt 105, is controlled so that it ends in 60 seconds. Also in this embodiment, the combination of the above-described roughening operation counter CT, and the roughening timer TM makes up the timer for clocking the length of time having elapsed since the beginning of the abrading sequence, when the abrading process is carried out by moving the roughening roller 400 to the pressure application position.

Figure 14A:
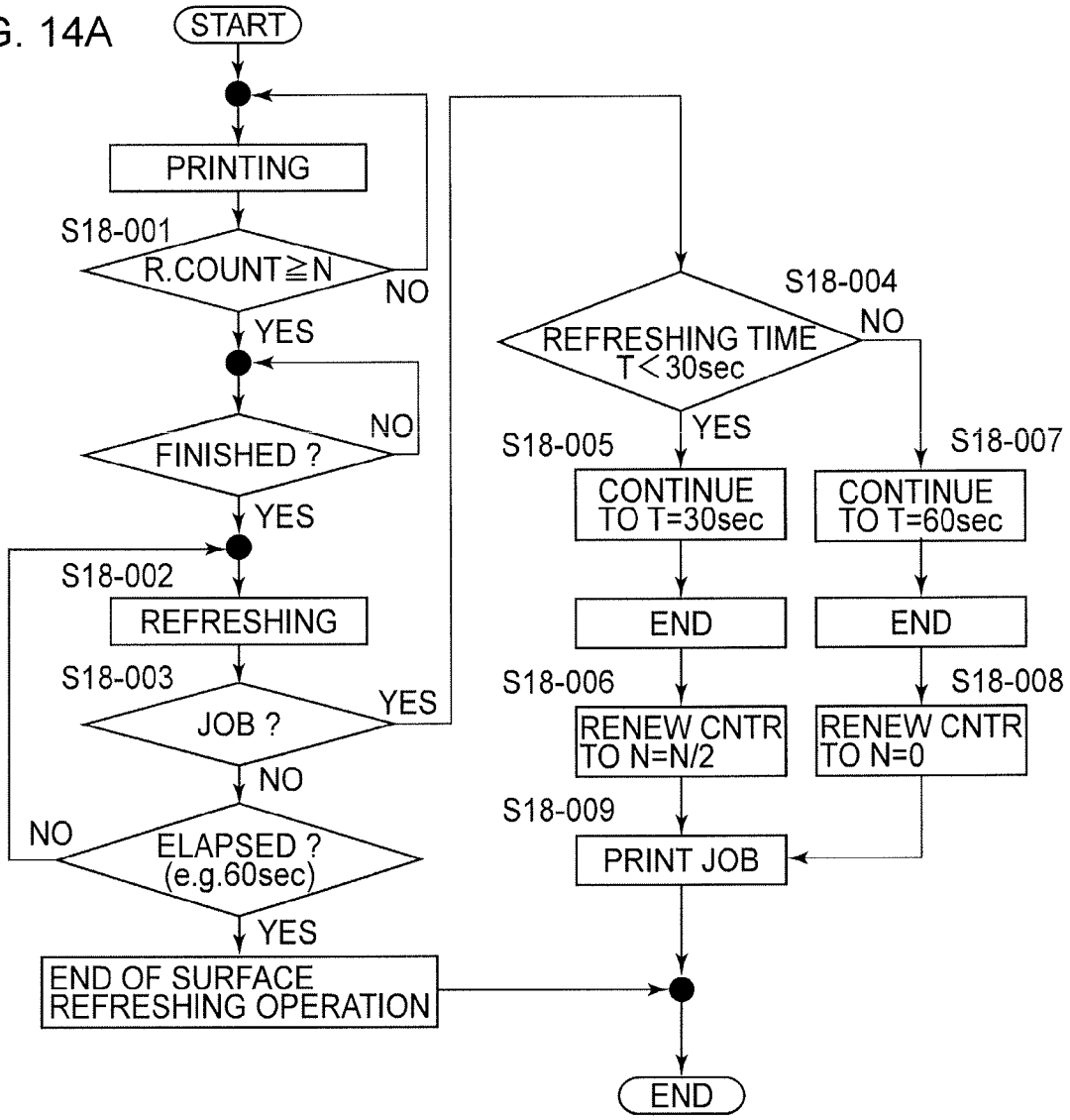
FIGS. 14A and 14B are flowcharts of the surface property restoration control sequence (roughening operation).
Figure 14B:
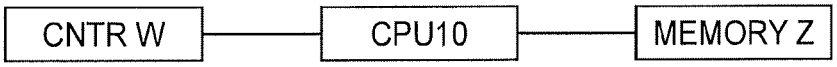

FIGS. 14A and 14B illustrate the timing with which the operation for restoring the surface properties of the fixation belt 105 with the use of the roughening roller 400 is started. Referring to the block diagram in FIG. 14A, in this embodiment, the CPU 10 counts the number of sheets S of the recording medium subjected to the fixation process (number of sheets subjected to image heating process) by the fixing device 100 in each printing job, with the use of a counter W (measuring section). Then, it cumulatively stores the sheet count in the memory Z.

Then, as the value (cumulative value: number of sheets S counted by counter W) reaches a preset number N (which in this embodiment is 3,000), the CPU 10 starts the operation (process for abrading the fixation belt with the use of a rotational abrading member) for restoring the surface properties of the fixation belt 105 with the use of the roughening roller 400, after the on-going printing job ends, or by interrupting the on-going printing job. As soon as the surface property restoration operation ends, the CPU 10 resets the memory Z to zero; it changes the cumulative value in the memory Z to zero. In a case where the on-going printing job was interrupted, the printing job is restarted to finish the remaining portion of the job, after the operation for restoring the surface properties of the fixation belt 105 is carried out.

However, it takes 60 seconds to carry out the surface property restoration operation in its entirety, as described above. Thus, if a new printing job is thrown in while the surface property restoration operation is carried out, this job cannot be done until the surface property restoration operation ends. Thus, in order to minimize the length of the downtime attributable to the surface property restoration operation, the on-going surface property restoration operation is interrupted according to the length of time necessary to finish the unfinished portion of the on-going roughening process, in order to start the new printing job, and the value (cumulative value) stored in the memory Z is reduced by a value proportional to the remaining portion of the interrupted surface property restoration operation.

FIG. 14A is a flowchart for illustrating the above-described surface property restoration operation. As the cumulative number of sheets S conveyed through the fixing device 100 becomes greater than a preset number N <S18-001>, the CPU 10 starts the surface property restoration operation after the on-going printing job ends <S18-002>.

In a case where a printing job is thrown in while the surface property restoration operation is carried out <S18-003>, the CPU 10 decides whether the surface property restoration operation is to be continued or interrupted, with reference to the remaining length T of time of the on-going surface property restoration operation, at the moment when the printing job was thrown in <S18-004>.

If the remaining length T of time is no more than 30 seconds, the CPU 10 continues the surface property restoration operation until T becomes 30<S18-004>.

If the remaining time T is no less than 30 seconds, the CPU 10 continues the surface property restoration operation for 60 seconds (T=60) <S18-007>, and resets the cumulative value in the counter to zero <S18-008>. As the surface property restoration operation ends, the CPU 10 puts the printer 1 on standby to wait for the next printing job <S18-009>.

The control sequences shown in FIGS. 12 and 14 can be summarized as follows.

1) The printer 1 has the timers CT and TM for measuring the length of time which elapses after the roughening roller 400 is moved to the pressure application position (contact position) to carry out the abrading process; the CPU 10 (control section) which determines, based on the length of time the abrading process was carried out, which was measured with the use of the measuring sections (timers) CT and TM, whether the abrading process is to be continued, or interrupted to carry out the fixing process. The above-described command for making the printer 1 (fixing device 100) carry out a fixing process is issued as the CPU 10 receives a new printing job.

Regarding the above-described control, the printer 1 (fixing device 100) may be structured so that instead of using the length of time the abrading process was carried out, the length of time the abrading process has to be carried out to complete the on-going abrading may be used as the reference.

2) If the length of time measured by the measuring sections CT and TM after the abrading process began to be carried out is longer than a preset value, the CPU 10 continues the on-going abrading process. On the other hand, if it is no more than the preset value, the CPU 10 interrupts the on-going abrading process, and makes the fixing device 100 carry out the fixation process.

3) The printer 1 has a measuring section (counter) W for counting the number of sheets S subjected to a fixing process, and if the number of sheets S counted by the measuring section W is no less than a preset value, the CPU 10 makes the printer 1 (fixing device 100) carry out the abrading process while the fixation process is not being carried out.

4) If the length of time measured by the measuring sections CT and TM after the starting of the abrading process is no less than a preset value, the CPU 10 resets the value in the measuring section W to zero as soon as the abrading process is completed. On the other hand, if the length of time measured by the measuring sections CT and TM after the starting of the abrading process is no more than a preset value, the CPU 10 interrupts the on-going abrading process, and makes the fixing device 100 carry out the fixation process. Further, it reduces the value in the measuring section W.

5) When the fixing process needs to be carried out, the moving mechanism moves the roughening roller 400 into the noncontact position.

6) The printer 1 has the counter W for counting the number of sheets which were subjected to the fixing operation by the combination of the fixation belt 105 and the pressure belt 120. It has also the CPU 10 (executing section) which makes the fixing device 100 to carry out the abrading process by moving the roughening roller 400 into the pressure application position (contact position) when the number of sheets S counted by the counter W is no less than a preset value, and the fixing process is not carried out.

If the CPU 10 receives a fixing process start command while the abrading process is carried out, and the relationship among the length of time Ts the on-going abrading process has been carried out, the total length T of time necessary to carrying out the on-going abrading process in its entirety, and a preset length Tc of time is: $T-Ts \geq Tc$, the CPU 10 continues the on-going abrading process until it is completed. On the other hand, if it is: $T-Ts < Tc$, the CPU 10 interrupts the on-going abrading process, and controls the fixing device 100 so that the fixing device 100 carries out the fixation process, and reduces the value in the counter W.

That is, the CPU 10 interrupts the refresh operation (on-going abrading process) according to the length of time which is remaining to be spent to complete the on-going abrading process when a new printing job is thrown in. Then, it starts the new print job, and reduces the refresh count value according to the remaining length of time. Thus, it is possible to reduce the length of the downtime attributable to the roughening operation, and also, to obtain satisfactory roughening effects.

Figure 15:
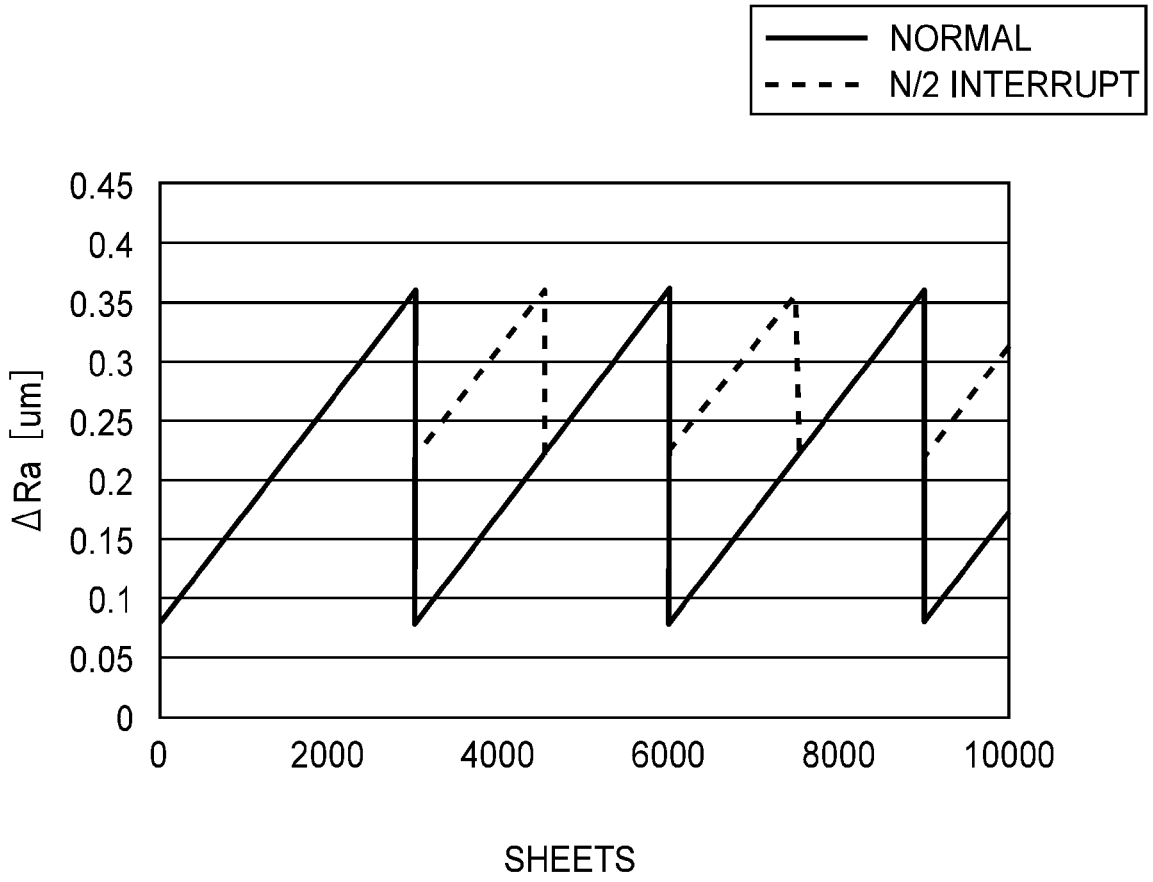
FIG. 15 is a graph for describing the effects of the surface property restoration sequence carried out with no interruption, and that with an interruption.

The comparison, in terms of the effects of the roughening process upon the restoration of the surface properties of the fixation belt 105, between a case in which a job is thrown in 30 seconds after a surface property restoration operation is started, and therefore, the surface property restoration operation was interrupted, and a case in which the surface property restoration operation is continued without interruption, is shown in FIG. 15. Here, in FIG. 15, the horizontal axis represents the number of conveyed sheets, and vertical axis represents the amount ΔRa of difference, in terms of the surface roughness Ra, between the portions of the fixation belt 105, which came into contact with the edges of the sheets S, and the rest of the fixation belt 105. This means that the smaller in value the amount ΔRa, the better the surface property restoration. It is evident from FIG. 15 that even in the case where the surface property restoration operation was interrupted 30 seconds after it was started, the value of ΔRa was kept roughly the same as in the case where the surface property restoration operation was not interrupted.

By the way, this embodiment was described with reference to a case where the operation for restoring the surface properties of the fixation belt 105 with the use of the roughening roller 400 is started after a preset number of sheets S of the recording medium were conveyed through the fixing device 100, for fixation. However, this embodiment is not intended to limit the present invention in scope. That is, the operation for restoring the surface properties of the fixation belt 105 may be started according to the count of specific sheets. Further, it may be carried out before a printing job which is different in sheet size from the immediately preceding printing job is started. Moreover, it may be started by an instruction inputted by a user with a proper timing while the printer 1 is kept on standby for the next printing job.

Further, this embodiment was described with reference to the remaining length of time for the surface property restoration operation. However, this embodiment is not intended to limit the present invention in terms of the variables based on which the surface property restoration operation is started. For example, the surface property restoration operation may be started based on the length of time the surface property restoration operation was being carried out.

In the foregoing, one of the preferred embodiments of the present invention was described. However, the present invention can be embodied in the form of various fixing devices (image forming apparatuses) which are different in structure from the fixing device 100 (printer 1) in the preceding embodiment. In the preceding embodiment, it was the fixation belt 105 that was abraded by the roughening roller 400. However, the embodiment is not intended to limit the present invention in scope. For example, the present invention is also applicable to a case where the pressure belt 120 is abraded by the roughening roller 400. The effects of the application are similar to those described with reference to the fixation belt 105. This application is particularly effective when an image is formed on both surfaces of a sheet S of the recording medium.

That is, the present invention is applicable to a fixing device structured so that the first rotational member faces the surface, on which a toner image to be fixed is borne, or the opposite surface from the surface on which a toner image to be fixed is borne.

Further, in the above-described embodiment, the fixing device employed the fixation belt 105 and the pressure belt 120. However, the application of the present invention is not limited to the fixing device 100 in the preceding embodiment. It is also similarly applicable to a fixing device which employs a fixation roller in place of the fixation belt 105, or a fixing device which employs a pressure roller, or a rotational pad which is low in coefficient of friction, in place of the pressure belt 120.

Further, in the above-described embodiment, the fixing device was for fixing an unfixed toner image t to a sheet S of the recording medium. However, the application of the present invention is not limited to a fixing device for fixing an unfixed toner image t to a sheet of the recording medium. For example, the present invention is also applicable to an apparatus (which also will be referred to as fixing device) for applying heat and pressure to a toner image which has been temporarily fixed to a sheet of the recording medium, in order to improve the toner image in gloss. The effects of the application are similar to those described above.

Further, in the above-described embodiment, the heating section used a heating method based on electromagnetic induction. However, the application of the present invention is not limited to a fixing device, the heating section of which uses a heating method based on electromagnetic induction. That is, the present invention is also applicable to a fixing device which employs a heating section which uses a heating method other than electromagnetic induction. For example, the present invention is also applicable to a fixing device, the heating section of which employs a halogen heater or the like. More concretely, the present invention is also similarly applicable to a fixing device, the driver roller 131 and/or the pressure roller 121 of which has an internal heating section made up of a halogen heater or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-075363 filed on Apr. 1, 2014, which is hereby incorporated by reference herein in its entirety.

What is claimed is:

1. An image heating apparatus comprising:

first and second rotatable members cooperative with each other to form a nip therebetween for heating a toner image on a sheet;

a rubbing rotatable member configured to rub an outer surface of said first rotatable member;

a moving mechanism configured to move said rubbing rotatable member between a contact position in which said rubbing rotatable member contacts said first rotatable member and a spacing position in which said rubbing rotatable member is spaced from said first rotatable member;

a measuring portion configured to measure the time elapsed from the start of a rubbing process executed with said rubbing rotatable member placed in the contact position; and a controller configured to determine, upon receipt of an execution instruction of an image heating process during the execution of the rubbing process, whether to continue the rubbing process or to interrupt the rubbing process and execute the image heating process, on the basis of the time measured by said measuring portion.

2. An apparatus according to claim 1, wherein said controller continues the rubbing process in the case that the measured time is not less than a predetermined time, and interrupts the rubbing process and executes the image heating process when the measured time is less than the predetermined time.

3. An apparatus according to claim 1, further comprising a counter configured to count the number of the sheets subjected to the image heating process, wherein said controller executes the rubbing process in a non-image heating process period in accordance with the number of the sheets counted by said counter.

4. An apparatus according to claim 3, further comprising a heating portion configured to heat said first rotatable member when said image heating process is executed, and wherein the rubbing process is executed in a state that first rotatable member is heated by said heating portion.

5. An apparatus according to claim 1, wherein said moving mechanism places said rubbing rotatable member in the spacing position when the image heating process is executed.

6. An apparatus according to claim 1, wherein said rubbing rotatable member includes #1000-#4000 abrasive grain at the surface thereof.

7. An apparatus according to claim 1, wherein said rubbing rotatable member has a surface roughness Ra of 1.0-5.0.

8. An apparatus according to claim 1, wherein by the rubbing process of said rubbing rotatable member, the surface roughness Rz of said first rotatable member becomes 0.5-1.0.

9. An apparatus according to claim 1, wherein said first rotatable member includes an endless belt rotatably supported by a supporting roller at an inner surface, and said moving mechanism moves said rubbing rotatable member to the contact position such that said endless belt is sandwiched between said rubbing rotatable member and said supporting roller.

10. An apparatus according to claim 1, wherein said first rotatable member is provided to contact a toner image carrying surface of the sheet.

* * * * *